US009748658B2

(12) United States Patent
Motegi et al.

(10) Patent No.: US 9,748,658 B2
(45) Date of Patent: Aug. 29, 2017

(54) WIDEBAND ANTENNA

(71) Applicant: NIPPON ANTENNA CO., LTD., Tokyo (JP)

(72) Inventors: Takeshi Motegi, Warabi (JP); Motoki Oshima, Warabi (JP); Shinichi Kitazawa, Warabi (JP)

(73) Assignee: NIPPON ANTENNA CO., LTD., Tokyo (JP)

( * ) Notice: Subject to any disclaimer, the term of this patent is extended or adjusted under 35 U.S.C. 154(b) by 0 days.

(21) Appl. No.: 15/066,516

(22) Filed: Mar. 10, 2016

(65) Prior Publication Data

US 2017/0033472 A1 Feb. 2, 2017

(30) Foreign Application Priority Data

Jul. 27, 2015 (JP) ..... 2015-147645

(51) Int. Cl.

| | |
|---|---|
| ***H01Q 21/30*** | (2006.01) |
| ***H01Q 9/26*** | (2006.01) |
| ***H01Q 9/28*** | (2006.01) |
| ***H01Q 21/10*** | (2006.01) |
| ***H01Q 5/371*** | (2015.01) |
| ***H01Q 5/385*** | (2015.01) |

(52) U.S. Cl.

CPC ..... *H01Q 9/26* (2013.01); *H01Q 5/371* (2015.01); *H01Q 5/385* (2015.01); *H01Q 9/285* (2013.01); *H01Q 21/10* (2013.01)

(58) Field of Classification Search

CPC ..... H01Q 9/26; H01Q 5/371; H01Q 5/385; H01Q 9/285; H01Q 21/10; H01Q 9/16; H01Q 5/378; H01Q 5/382; H01Q 5/49

USPC ..... 343/700

See application file for complete search history.

(56) References Cited

U.S. PATENT DOCUMENTS 5,594,455 A * 1/1997 Hori ..... H01Q 9/0414 343/700 MS
2005/0206573 A1* 9/2005 Iigusa ..... H01Q 3/242 343/770
2006/0232488 A1* 10/2006 Wang ..... H01Q 1/242 343/795

(Continued)

FOREIGN PATENT DOCUMENTS

JP 5048012 B2 10/2012

*Primary Examiner* — Dieu H Duong
*Assistant Examiner* — Bamidele A Jegede
(74) *Attorney, Agent, or Firm* — Oliff PLC

(57) ABSTRACT

First and second hot elements are formed on the front surface of a long and thin substrate. First and second earth elements are formed on the rear surface of the substrate. First and second parasitic elements are disposed adjacent to the hot elements and the earth elements, thereby forming a first-stage element. A second-stage element has a corresponding structure. A first branch line and a second branch line are formed on the front surface. The hot elements of the first-stage and second-stage elements are fed from a feeding point through the first and second branch lines. An earth line is formed on the rear surface. The earth elements of the first-stage and second-stage elements are fed from the feeding point through the earth line. The hot element and the earth element form a dipole antenna. The parasitic element is disposed adjacent to the dipole antenna to broaden a frequency band.

24 Claims, 35 Drawing Sheets

(56) References Cited

U.S. PATENT DOCUMENTS

2007/0024423 A1* 2/2007 Nikitin ..... G06K 19/0723
340/10.1

* cited by examiner

Vertical plane radiation pattern

θ1=120deg f = 2570MHz

Horizontal plane radiation pattern

θ1=90deg f = 2570MHz

Vertical plane radiation pattern

Vertical plane radiation pattern

Vertical plane radiation pattern

Horizontal plane radiation pattern

Vertical plane radiation pattern

Horizontal plane radiation pattern

Vertical plane radiation pattern

Vertical plane radiation pattern

WIDEBAND ANTENNA

TECHNICAL FIELD

This invention relates to a compact wideband antenna mainly used for communication modules or broadband communications.

BACKGROUND ART

In an antenna known as a base station antenna, a plurality of antenna elements is arranged in multiple stages in a linear pattern to achieve high-gain and omnidirectional characteristics in a horizontal plane and radiation directional characteristics of a sharp beam. Such an antenna is divided into a series feed type antenna of feeding a plurality of antenna elements connected in series and a parallel feed type antenna of feeding a plurality of antenna elements by distributing power between the antenna elements. The directional characteristics of the antenna are determined in response to the amount of exciting power (amplitude value) to be fed to each antenna element and an excitation phase.

FIGS. 41(*a*) and 41(*b*) are a front view and a bottom view respectively showing the structure of a conventional two-stage collinear antenna 200 as a series feed type antenna.

The conventional two-stage collinear antenna 200 shown in FIGS. 41(*a*) and 41(*b*) has a stack of a first-stage sleeve element 210 and a second-stage sleeve element 211 each forming a dipole antenna. The first-stage sleeve element 210 is formed of a dipole antenna including a cylindrical upper sleeve pipe 210*a* and a cylindrical lower sleeve pipe 210*b* facing each other. Likewise, the second-stage sleeve element 211 is formed of a dipole antenna including a cylindrical upper sleeve pipe 211*a* and a cylindrical lower sleeve pipe 211*b* facing each other. The upper sleeve pipes 210*a* and 211*a* and the lower sleeve pipes 210*b* and 211*b* forming the dipole antennas have an electrical length of about $\lambda/4$, where $\lambda$ is the wavelength of a usable frequency. The first-stage and second-stage sleeve elements 210 and 211 are fed in series through two feeding cables including a first feeding cable 212 and a second feeding cable 213 used for feeding frequency signals of different frequencies. The first and second feeding cables 212 and 213 are each passed through the first-stage and second-stage sleeve elements 210 and 211. The electrical length of each of the first and second feeding cables 212 and 213 between respective feeding points of the sleeve elements in the first and second stages are determined to be about an integral multiple of the wavelength of a frequency signal being transmitted. In this way, the first-stage and second-stage sleeve elements 210 and 211 are fed in phase with different frequency signals. As a result, radiation patterns appropriate for communication can be obtained at two frequencies.

PRIOR ART LITERATURES

Patent Literatures

Patent Literature 1: Publication of Japanese Patent No. 5048012

SUMMARY OF INVENTION

Problem to be Solved by Invention

The conventional collinear antenna 200 operates at two frequencies to become functional as a wideband antenna.

However, the conventional collinear antenna 200 has a problem in that it requires a large parts count and complicated assembly steps.

It is therefore an object of this invention to provide a wideband antenna of a simple structure having a low parts count, capable of enhancing assembly performance, capable of reducing cost, and capable of increasing a yield if being produced in large quantity.

Means of Solving Problem

To achieve the aforementioned object, a wideband antenna of this invention is principally characterized in that the wideband antenna comprises: a long and thin substrate including unit elements and dipole antennas arranged in multiple stages in a longitudinal direction, the unit elements each being formed of a hot element, an earth element forming the dipole antenna together with the hot element, and a parasitic element disposed adjacent to the dipole antenna, the dipole antennas each being formed of the hot element formed on one surface and the earth element formed on an opposite surface; and the parasitic element having an arc-like shape disposed adjacent to the dipole antenna. A branch line is formed on the one surface of the substrate. The branch line is connected to a hot side of a feeding point and used for feeding each hot element of the unit element in each of the multiple stages. An earth connection line is formed on the opposite surface of the substrate. The earth connection line is connected to an earth side of the feeding point and used for feeding each earth element of the unit element in each of the multiple stages.

Advantageous Effects of Invention

The wideband antenna of this invention has a simple structure including the unit element formed of the hot element and the earth element, the branch line, and the earth connection line formed on the substrate. Thus, the wideband antenna of this invention has a low parts count, capable of enhancing assembly performance, capable of reducing cost, and capable of increasing a yield if being produced in large quantity.

EMBODIMENT FOR CARRYING OUT INVENTION

Figure 1A:
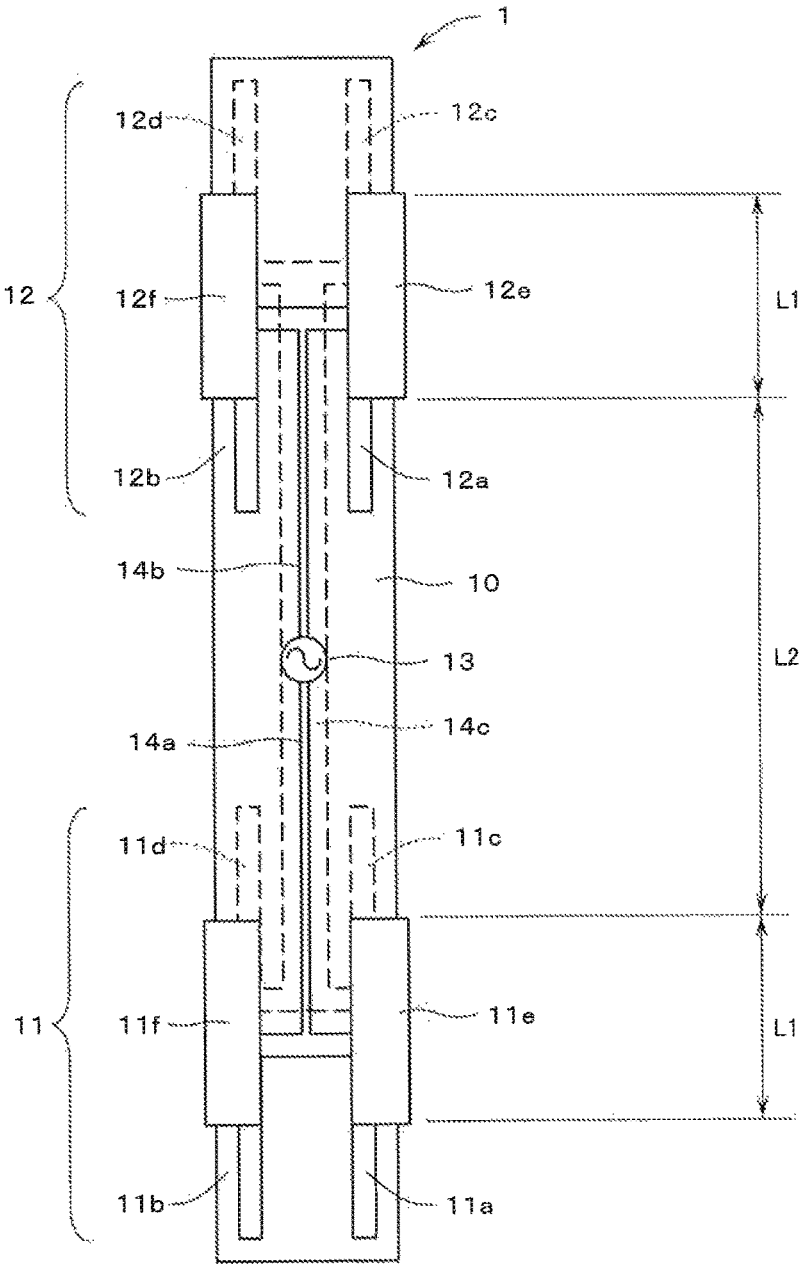
FIG. 1(*a*) is a front view showing the structure of a wideband antenna according to a first embodiment of this invention and FIG. 1(*b*) is a top view of FIG. 1(*a*).
Figure 1B:
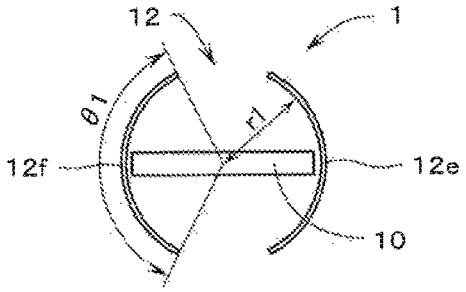
Figure 2A:
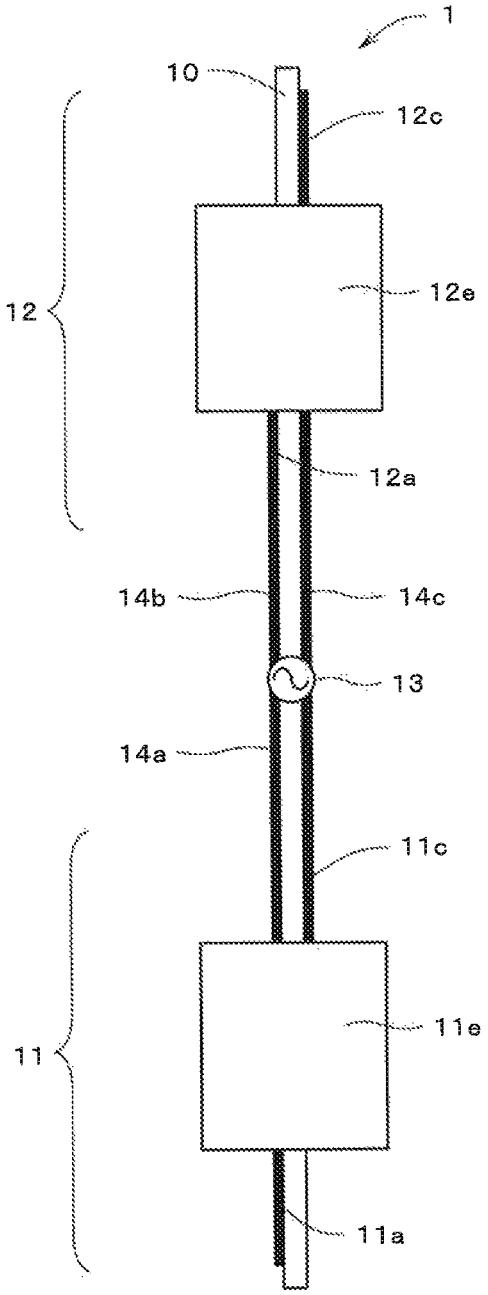
FIG. 2(*a*) is a side view showing the structure of the wideband antenna according to the first embodiment of this invention and FIG. 2(*b*) is a top view of FIG. 2(*a*).
Figure 2B:
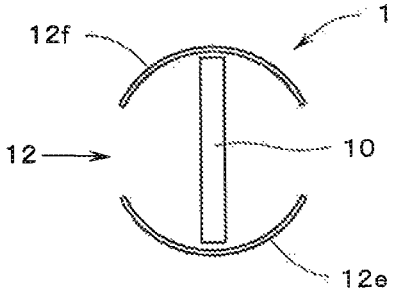
Figure 3A:
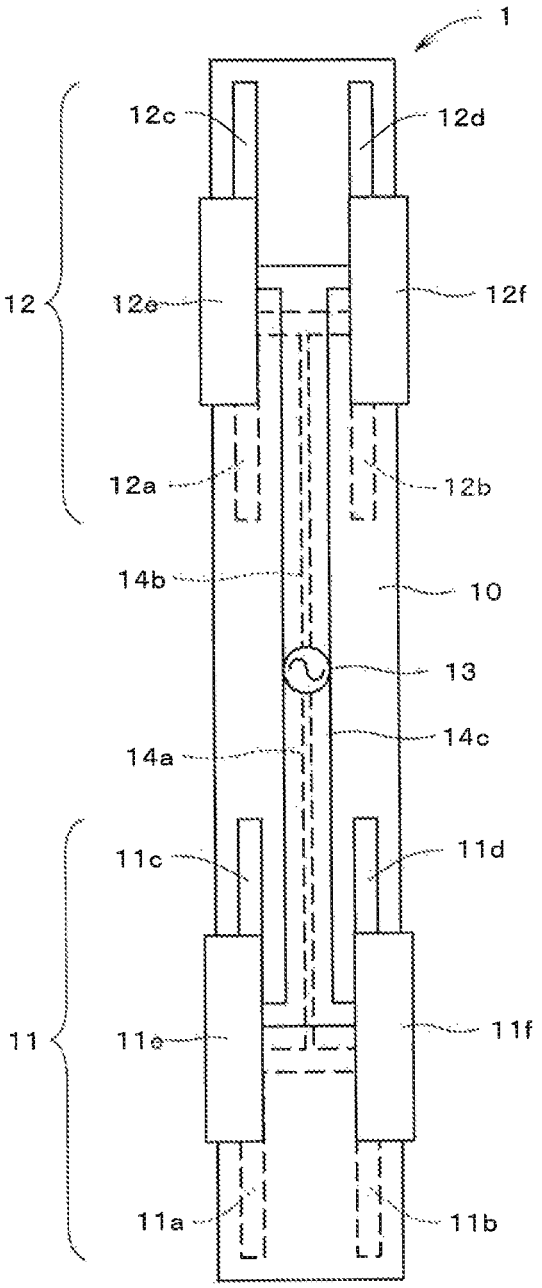
FIG. 3(*a*) is a back view showing the structure of the wideband antenna according to the first embodiment of this invention and FIG. 3(*b*) is a top view of FIG. 3(*a*).
Figure 3B:
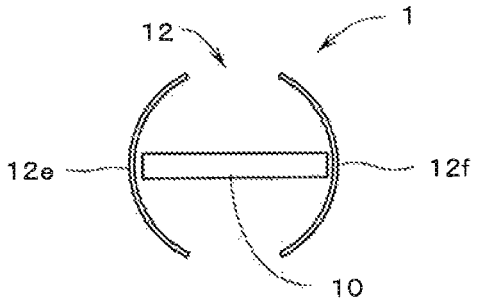
Figure 4:
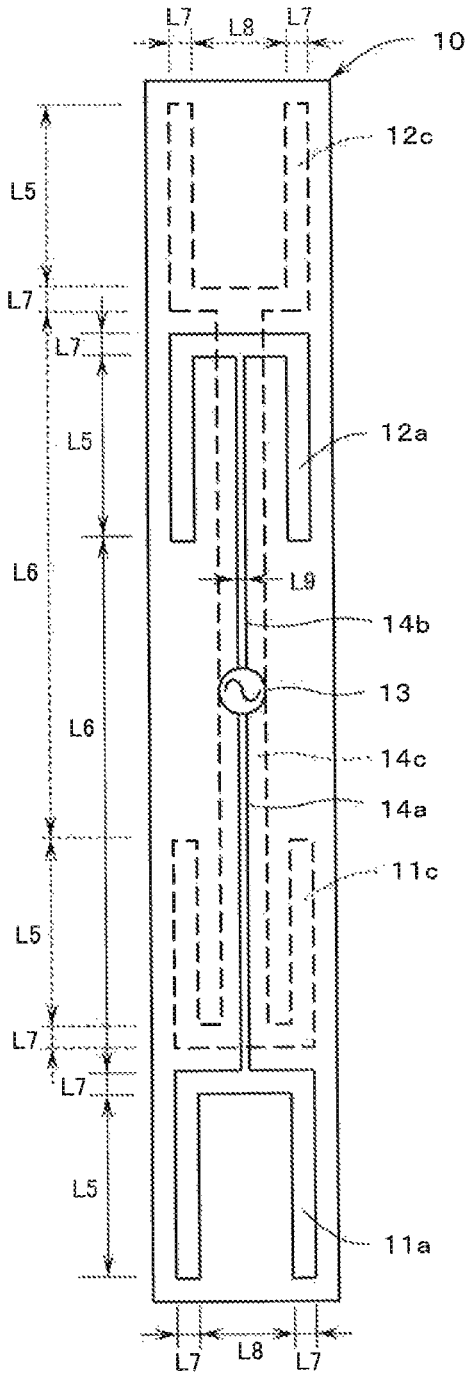
FIG. 4 is a front view showing the structure of a substrate of the wideband antenna according to the first embodiment of this invention.
Figure 5:
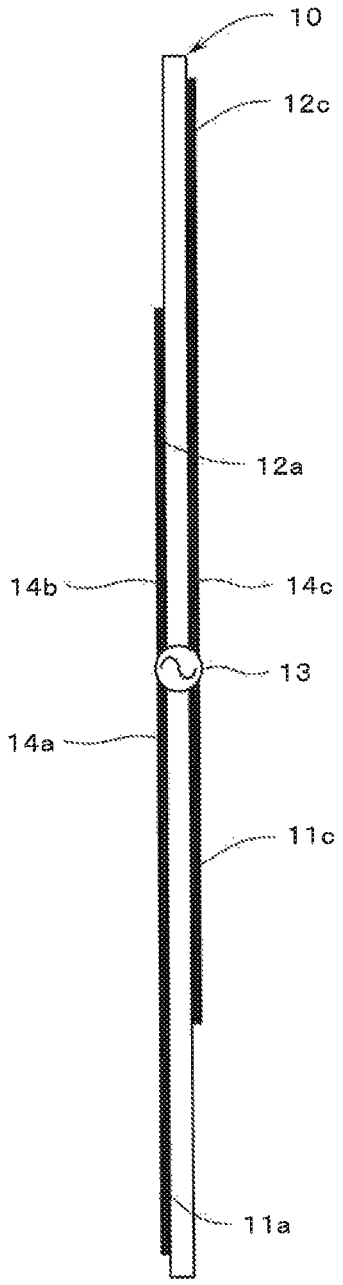
FIG. 5 is a side view showing the structure of the substrate of the wideband antenna according to the first embodiment of this invention.
Figure 6:
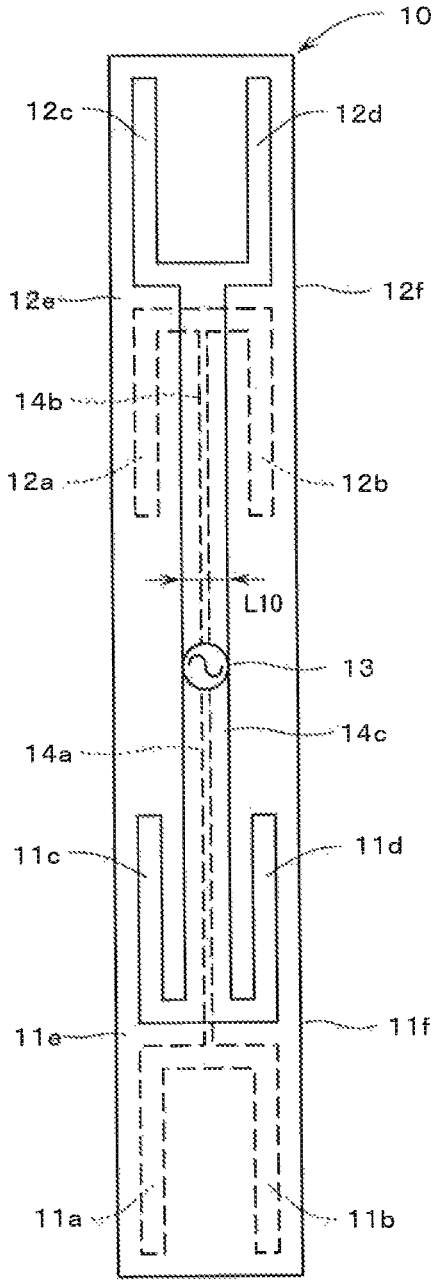
FIG. 6 is a back view showing the structure of the substrate of the wideband antenna according to the first embodiment of this invention.

FIG. 1(*a*) is a front view showing the structure of a wideband antenna 1 according to a first embodiment of this invention. FIG. 1(*b*) is a top view of FIG. 1(*a*). FIG. 2(*a*) is a side view showing the structure of the wideband antenna 1 according to the first embodiment. FIG. 2(*b*) is a top view of FIG. 2(*a*). FIG. 3(*a*) is a back view showing the structure of the wideband antenna 1 according to the first embodiment. FIG. 3(*b*) is a top view of FIG. 3(*a*). FIG. 4 is a front view showing the structure of a substrate of the wideband antenna 1 according to the first embodiment. FIG. 5 is a side view showing the structure of the substrate of the wideband antenna 1 according to the first embodiment. FIG. 6 is a back view showing the structure of the substrate of the wideband antenna 1 according to the first embodiment.

The wideband antenna 1 of the first embodiment of this invention shown in these drawings has a stack in two stages including a first-stage element 11 and a second-stage element 12 each formed of a dipole antenna. The first-stage and second-stage elements 11 and 12 are formed on a substrate 10 such as a fluorine resin substrate having favorable high-frequency characteristics. Specifically, two hot elements forming the first-stage element 11 including a hot element 11*a* and a hot element 11*b* are formed in a pair on a lower part of the front surface of the substrate 10 having a vertically long and thin rectangular shape in such a manner as to extend in a vertically long and thin rectangular shape along the opposite edges of the front surface in the longitudinal direction. Two hot elements forming the second-stage element 12 including a hot element 12*a* and a hot element 12*b* are formed in a pair on a part of the front surface of the substrate 10 above the center of the front surface in such a manner as to extend in a vertically long and thin rectangular shape along the opposite edges of the front surface in the longitudinal direction. Two earth elements forming the first-stage element 11 including an earth element 11*c* and an earth element 11*d* are formed in a pair on a part of the rear surface of the substrate 10 below the center of the rear surface in such a manner as to extend in a vertically long and thin rectangular shape along the opposite edges of the rear surface in the longitudinal direction. Two earth elements forming the second-stage element 12 including an earth element 12*c* and an earth element 12*d* are formed in a pair on an upper part of the rear surface of the substrate 10 in such a manner as to extend in a vertically long and thin rectangular shape along the opposite edges of the rear surface in the longitudinal direction. In the first-stage element 11, the hot element 11*a* and the earth element 11*c* are formed to face each other. Further, the hot element 11*b* and the earth element 11*d* are formed to face each other. In this way, two dipole antennas are formed. In the second-stage element 12, the hot element 12*a* and the earth element 12*c* are formed to face each other. Further, the hot element 12*b* and the earth element 12*d* are formed to face each other. In this way, two dipole antennas are formed.

In the first-stage element 11, an arc-like parasitic element 11*e* having a radius r1 and an arc angle θ1 is provided adjacent to the dipole antenna formed of the hot element 11*a* and the earth element 11*c* in such a manner as to surround this dipole antenna. Further, an arc-like parasitic element 11*f* having the radius r1 and the arc angle θ1 is provided adjacent to the dipole antenna formed of the hot element 11*b* and the earth element 11*d* in such a manner as to surround this dipole antenna. In the second-stage element 12, an arc-like parasitic element 12*e* having the radius r1 and the arc angle θ1 is provided adjacent to the dipole antenna formed of the hot element 12*a* and the earth element 12*c* in such a manner as to surround this dipole antenna. Further, an arc-like parasitic element 12*f* having the radius r1 and the arc angle θ1 is provided adjacent to the dipole antenna formed of the hot element 12*b* and the earth element 12*d* in such a manner as to surround this dipole antenna. In the description given below, the elements in each of the first-stage and second-stage elements 11 and 12 are called unit elements.

A feeding point 13 is arranged in a substantially central part of the substrate 10. A first branch line 14*a* and a second branch line 14*b* are connected to a hot side of the feeding point 13 and formed on the front surface of the substrate 10 in such a manner as to extend upward and downward substantially along the center line of the front surface in the longitudinal direction. The first branch line 14*a* extending downward from the feeding point 13 is connected to the respective tips of the hot elements 11*a* and 11*b* of the first-stage element 11 bent into an L-shape in such a manner that the respective upper portions of the hot elements 11*a* and 11*b* face each other. The second branch line 14*b* extending upward from the feeding point 13 is connected to the respective tips of the hot elements 12*a* and 12*b* of the second-stage element 12 bent into an L-shape in a such manner that the respective upper portions of the hot elements 12*a* and 12*b* face each other. An earth line 14*c* connected to an earth side of the feeding point 13 is formed into a large width on the rear surface of the substrate 10 in such a manner as to extend upward and downward substantially along the center line of the rear surface in the longitudinal direction. The earth line 14*c* extending downward from the feeding point 13 is connected to the respective tips of the earth elements 11*c* and 11*d* of the first-stage element 11 bent into an L-shape in such a manner that the respective lower portions of the earth elements 11*c* and 11*d* face each other. The earth line 14*c* extending upward from the feeding point 13 is connected to the respective tips of the earth elements 12*c* and 12*d* of the second-stage element 12 bent into an L-shape in such a manner that the respective lower portions of the earth elements 12*c* and 12*d* face each other. In this way, the first-stage and second-stage elements 11 and 12 are fed in parallel from the feeding point 13 through a transmission line including the first and second branch lines 14*a* and 14*b* and the earth line 14*c*.

The first and second branch lines 14*a* and 14*b* formed on the front surface of the substrate 10 extend over the wide earth line 14*c* formed on the rear surface of the substrate 10 and the aforementioned transmission line functions as a stripline. The first-stage and second-stage elements 11 and 12 are fed in parallel from the feeding point 13 through the stripline.

As shown in FIG. 1, in the wideband antenna 1 of the first embodiment of this invention having the aforementioned structure, the parasitic elements 11*e*, 11*f*, 12*e*, and 12*f* each have a length L1. A gap between the upper end of each of the parasitic elements 11*e* and 11*f* of the first-stage element 11 to a corresponding one of the lower ends of the parasitic elements 12*e* and 12*f* of the second-stage element 12 is L2. As shown in FIGS. 3 and 4, the hot elements 11*a*, 11*b*, 12*a*, and 12*b* each have a length L5 and a width L7. The earth elements 11*c*, 11*d*, 12*c*, and 12*d* each have the length L5 and the width L7. A gap between the upper end of each of the hot elements 11*a* and 11*b* of the first-stage element 11 to a corresponding one of the lower ends of the hot elements 12*a* and 12*b* of the second-stage element 12 is L6. A gap between the upper end of each of the earth elements 11*c* and 11*d* of the first-stage element 11 to a corresponding one of the lower ends of the earth elements 12*c* and 12*d* of the second-stage element 12 is L6. A gap between the hot elements 11*a* and 11*b* is L8. A gap between the hot elements 12*a* and 12*b* is L8. A gap between the earth elements 11*c* and 11*d* is L8. A gap between the earth elements 12*c* and 12*d* is L8. The first and second branch lines 14*a* and 14*b* each have a width L9. As shown in FIG. 6, the earth line 14*c* has a width L10.

By placing the wideband antenna 1 of the first embodiment of this invention having the aforementioned structure in a standing posture in a vertical plane, the two dipole antennas formed of the hot elements 11*a* and 11*b* and the earth elements 11*c* and 11*d* of the first-stage element 11 function as a vertically polarized antenna. Further, the two dipole antennas formed of the hot elements 12*a* and 12*b* and the earth elements 12*c* and 12*d* of the second-stage element 12 function as a vertically polarized antenna. By disposing the two parasitic elements 11*e* and 11*f* adjacent to the vertically polarized antenna of the first-stage element 11 and disposing the two parasitic elements 12*e* and 12*f* adjacent to the vertically polarized antenna of the second-stage element 12, the first-stage and second-stage elements 11 and 12 generate multiple resonance to broaden a frequency band. With the length L1 set at about 30 mm, the length L2 about 60 mm, the length L5 about 23 mm, the length L6 about 55.5 mm, the length L7 about 3 mm, the length L8 about 12.5 mm, the length L9 about 1 mm, the length L10 about 8 mm, the arc angle θ1 about 120 degrees, and the radius r1 about 10.5 mm, a voltage standing wave ratio (VSWR) of about 1.5 or less can be obtained in a frequency band from about 2500 to about 2650 MHz. The center frequency of this frequency band is 2575 MHz.

Figure 7A:
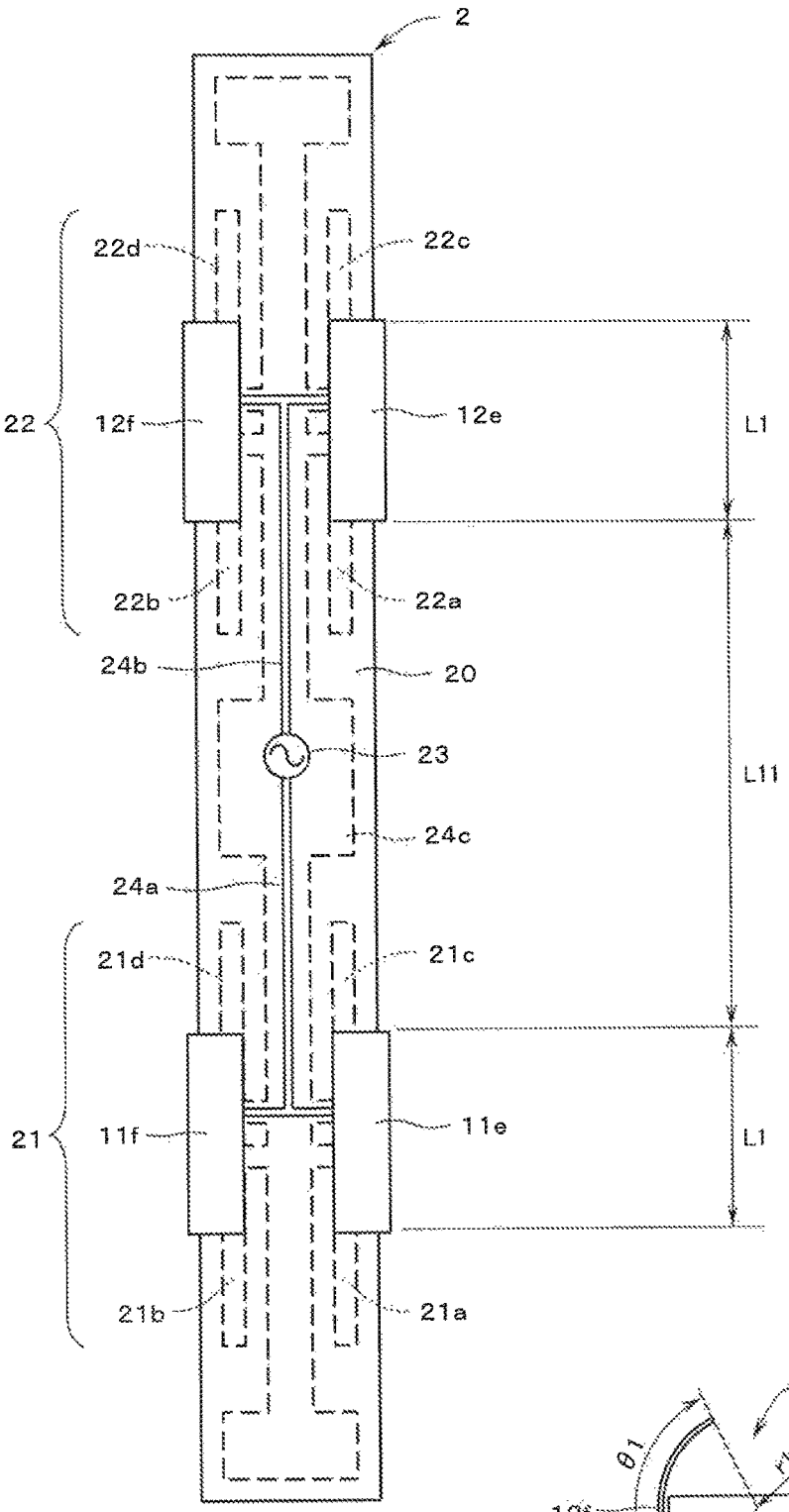
FIG. 7(*a*) is a front view showing the structure of a wideband antenna according to a second embodiment of this invention and FIG. 7(*b*) is a top view of FIG. 7(*a*).
Figure 7B:
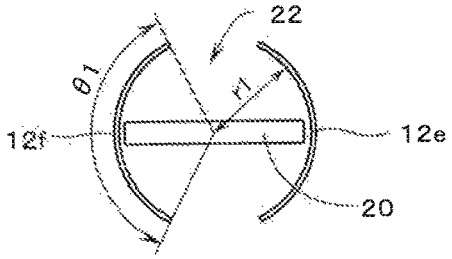
Figure 8:
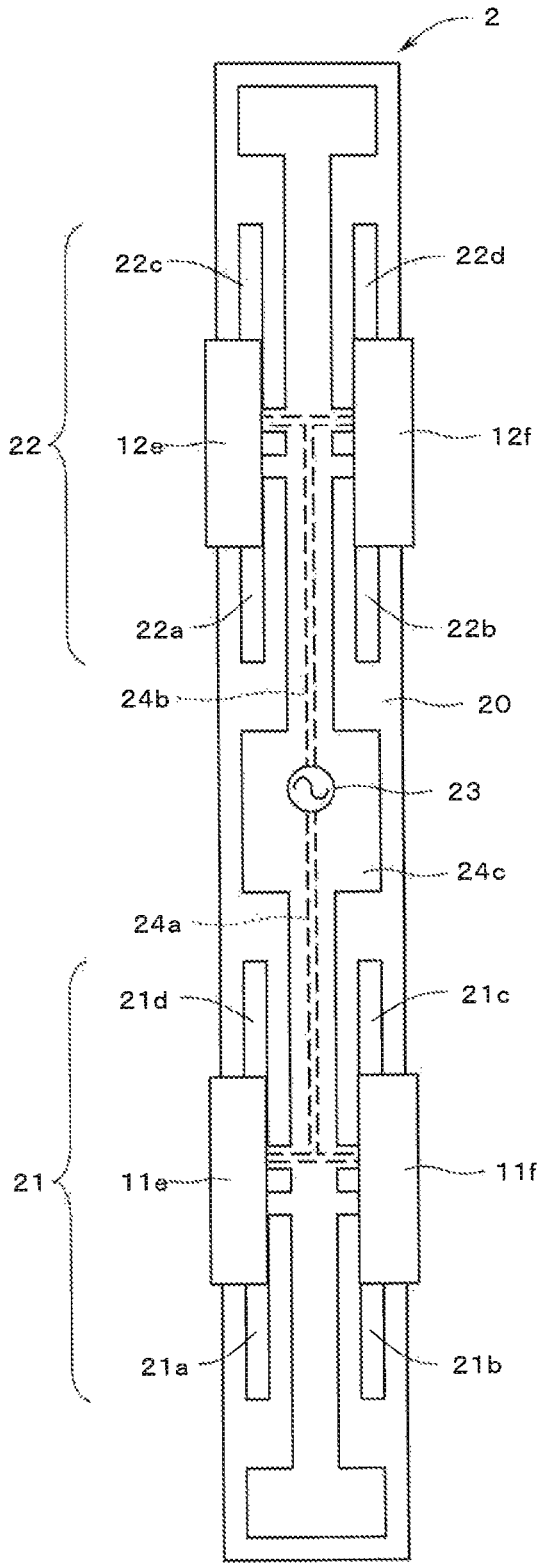
FIG. 8 is a back view showing the structure of the wideband antenna according to the second embodiment of this invention.
Figure 9:
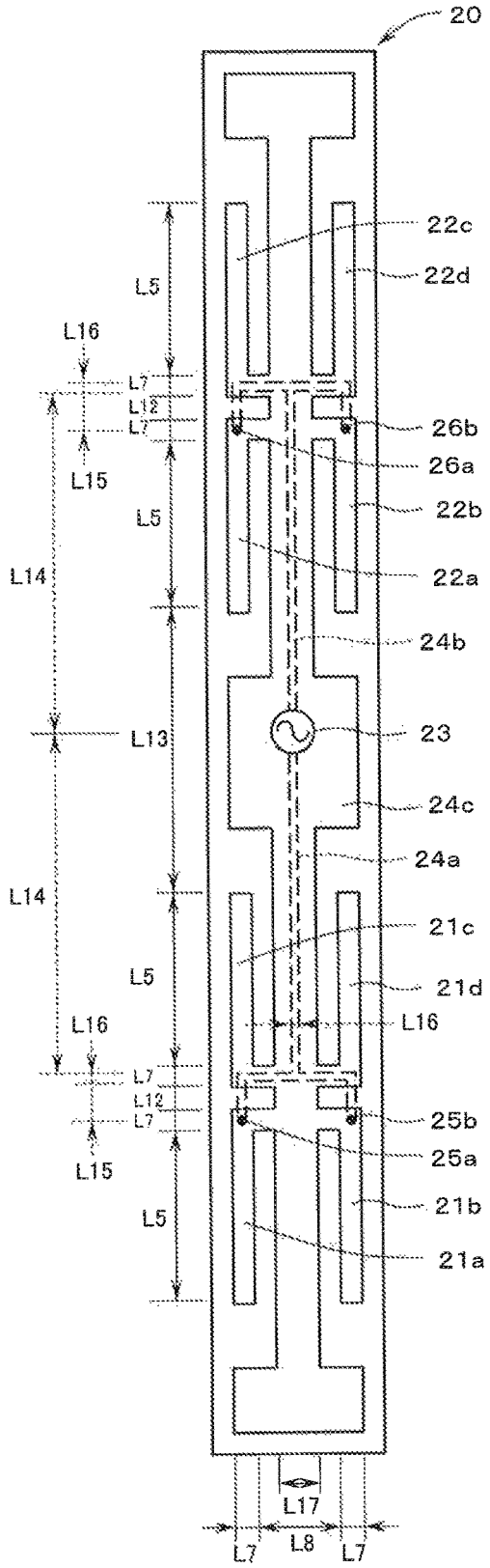
FIG. 9 is a back view showing the structure of a substrate of the wideband antenna according to the second embodiment of this invention.

The structure of a wideband antenna 2 according to a second embodiment of this invention is shown in FIGS. 7, 8, and 9. FIG. 7(*a*) is a front view showing the structure of the wideband antenna 2 according to the second embodiment. FIG. 7(*b*) is a top view of FIG. 7(*a*). FIG. 8 is a back view showing the structure of the wideband antenna 2 according to the second embodiment. FIG. 9 is a back view showing the structure of a substrate of the wideband antenna 2 according to the second embodiment.

As shown in these drawings, the wideband antenna 2 of the second embodiment of this invention includes two hot elements including a hot element 21*a* and a hot element 21*b* in a pair and two earth elements including an earth element 21*c* and an earth element 21*d* in a pair that form a first-stage element 21 and extend along the opposite edges of the rear surface of a substrate 20 in the longitudinal direction. The substrate 20 has a long and thin rectangular shape and for example is a fluorine resin substrate having favorable high-frequency characteristics. The wideband antenna 2 further includes two hot elements including a hot element 22*a* and a hot element 22*b* in a pair and two earth elements including an earth element 22*c* and an earth element 22*d* in a pair that form a second-stage element 22 and extend along the opposite edges of the rear surface of the substrate 20 in the longitudinal direction. The hot elements 21*a*, 21*b*, 22*a*, and 22*b* have the same shape as the hot elements 11*a*, 11*b*, 12*a*, and 12*b* of the wideband antenna 1 according to the first embodiment and are formed on the rear surface of the substrate 20 in the same positions as the hot elements 11*a*, 11*b*, 12*a*, and 12*b* respectively. The earth elements 21*c*, 21*d*, 22*c*, and 22*d* have the same shape as the earth elements 11*c*, 11*d*, 12*c*, and 12*d* of the wideband antenna 1 according to the first embodiment and are formed on the rear surface of the substrate 20 in the same positions as the earth elements 11*c*, 11*d*, 12*c*, and 12*d* respectively. In the first-stage element 21 as a unit element, the arc-like parasitic element 11*e* is provided adjacent to a dipole antenna formed of the hot element 21*a* and the earth element 21*c* in such a manner as to surround this dipole antenna. The arc-like parasitic element 11*f* is provided adjacent to a dipole antenna formed of the hot element 21*b* and the earth element 21*d* in such a manner as to surround this dipole antenna. In the second-stage element 22 as a unit element, the arc-like parasitic element 12*e* is provided adjacent to a dipole antenna formed of the hot element 22*a* and the earth element 22*c* in such a manner as to surround this dipole antenna. The arc-like parasitic element 12*f* is provided adjacent to a dipole antenna formed of the hot element 22*b* and the earth element 22*d* in such a manner as to surround this dipole antenna. As described above in relation to the wideband antenna 1 of the first embodiment, the parasitic elements 11*e*, 11*f*, 12*e*, and 12*f* have the radius r1 and the arc angle θ1.

A feeding point 23 is arranged in a position slightly above a substantially central part of the substrate 20. A first branch line 24*a* and a second branch line 24*b* are connected to a hot side of the feeding point 23 and formed on the front surface of the substrate 20 in such a manner as to extend upward and downward substantially along the center line of the front surface in the longitudinal direction. The first branch line 24*a* extending downward from the feeding point 23 has a tip formed into a T-shape. A portion of the first branch line 24*a* extending further from the T-shape portion is bent downward and the respective tips of the bent portions are connected to the hot elements 21*a* and 21*b* of the first-stage element 21 through a through hole 25*a* and a through hole 25*b* respectively. The second branch line 24*b* extending upward from the feeding point 23 has a tip formed into a T-shape. A portion of the second branch line 24*b* extending further from the T-shape portion is bent downward and the respective tips of the bent portions are connected to the hot elements 22*a* and 22*b* of the second-stage element 22 through a through hole 26*a* and a through hole 26*b* respectively. A wide earth line 24*c* connected to an earth side of the feeding point 23 is formed on the rear surface of the substrate 20 in such a manner as to extend upward and downward substantially along the center line of the rear surface in the longitudinal direction. The earth line 24*c* extending downward from the feeding point 23 is connected to respective end portions of the earth elements 21*c* and 21*d* of the first-stage element 21 bent into an L-shape in such a manner that the respective lower portions of the earth elements 21*c* and 21*d* face each other. The earth line 24*c* extending upward from the feeding point 23 is connected to respective end portions of the earth elements 22*c* and 22*d* of the second-stage element 22 bent into an L-shape in such a manner that the respective lower portions of the earth elements 22*c* and 22*d* face each other. In this way, the first-stage and second-stage elements 21 and 22 are fed in parallel from the feeding point 23 through a transmission line including the first and second branch lines 24*a* and 24*b* and the earth line 24*c*.

The first and second branch lines 24*a* and 24*b* formed on the front surface of the substrate 20 extend over the wide earth line 24*c* formed on the rear surface of the substrate 20 and the aforementioned transmission line functions as a stripline. The first-stage and second-stage elements 21 and 22 are fed in parallel from the feeding point 23 through the stripline. The hot elements 21*a* and 21*b* of the first-stage element 21 are bent into an L-shape in such a manner that the respective upper portions of the hot elements 21*a* and 21*b* face each other and the respective tips of these upper end portions are connected to the earth line 24*c*. The hot elements 22*a* and 22*b* of the second-stage element 22 are bent into an L-shape in such a manner that the respective upper portions of the hot elements 22*a* and 22*b* face each other and the respective tips of these upper end portions are connected to the earth line 24*c*.

As shown in FIG. 7, in the wideband antenna 2 of the second embodiment of this invention having the aforementioned structure, the parasitic elements 11*e*, 11*f*, 12*e*, and 12*f* each have a length L1. A gap between the upper end of each of the parasitic elements 11*e* and 11*f* of the first-stage element 21 to a corresponding one of the lower ends of the parasitic elements 12*e* and 12*f* of the second-stage element 12 is L11. As shown in FIG. 9, the hot elements 21*a*, 21*b*, 22*a*, and 22*b* each have a length L5 and a width L7. The earth elements 21*c*, 21*d*, 22*c*, and 22*d* each have the length L5 and the width L7. A gap between the upper end of each of the hot elements 21*a* and 21*b* to a corresponding one of the lower ends of the earth elements 21*c* and 21*d* of the first-stage element 21 is L12. A gap between the upper end of each of the hot elements 22*a* and 22*b* to a corresponding one of the lower ends of the earth elements 22*c* and 22*d* of the second-stage element 22 is L12. A gap between the upper end of each of the earth elements 21*c* and 21*d* of the first-stage element 21 to a corresponding one of the lower ends of the hot elements 22*a* and 22*b* of the second-stage element 22 is L13. A gap between the hot elements 21*a* and 21*b* is L8. A gap between the hot elements 22*a* and 22*b* is L8. A gap between the earth elements 21*c* and 21*d* is L8. A gap between the earth elements 22*c* and 22*d* is LB. The length of each of the first and second branch lines 24*a* and 24*b* from the feeding point 23 is L14. The first and second branch lines 24*a* and 24*b* each have a width L16. The earth line 24*c* has a width L17.

By placing the wideband antenna 2 of the second embodiment of this invention having the aforementioned structure in a standing posture in a vertical plane, the two dipole antennas formed of the hot elements 21*a* and 21*b* and the earth elements 21*c* and 21*d* of the first-stage element 21 function as a vertically polarized antenna. Further, the two dipole antennas formed of the hot elements 22*a* and 22*b* and the earth elements 22*c* and 22*d* of the second-stage element 22 function as a vertically polarized antenna. By disposing the two parasitic elements 11*e* and 11*f* adjacent to the vertically polarized antenna of the first-stage element 21 and disposing the two parasitic elements 12*e* and 12*f* adjacent to the vertically polarized antenna of the second-stage element 22, the first-stage and second-stage elements 21 and 22 generate multiple resonance to broaden a frequency band. With the length L1 set at about 30 mm, the length L11 about 58 mm, the length L5 about 23 mm, the length L13 about 33 mm, the length L7 about 3 mm, the length L8 about 12.5 mm, the length L12 about 3.5 mm, the length L14 about 39.5 mm, the length L15 about 6.5 mm, the length L16 about 1 mm, the length L17 about 12.5 mm, the arc angle θ1 about 120 degrees, and the radius r1 about 10.5 mm, a voltage standing wave ratio (VSWR) of about 1.5 or less can be obtained in a frequency band from about 2500 to about 2650 MHz. The center frequency of this frequency band is 2575 MHz. A gap between the through holes 25*a* and 25*b* and a gap between the through holes 26*a* and 26*b* are each set at about 15.3 mm.

Figure 10:
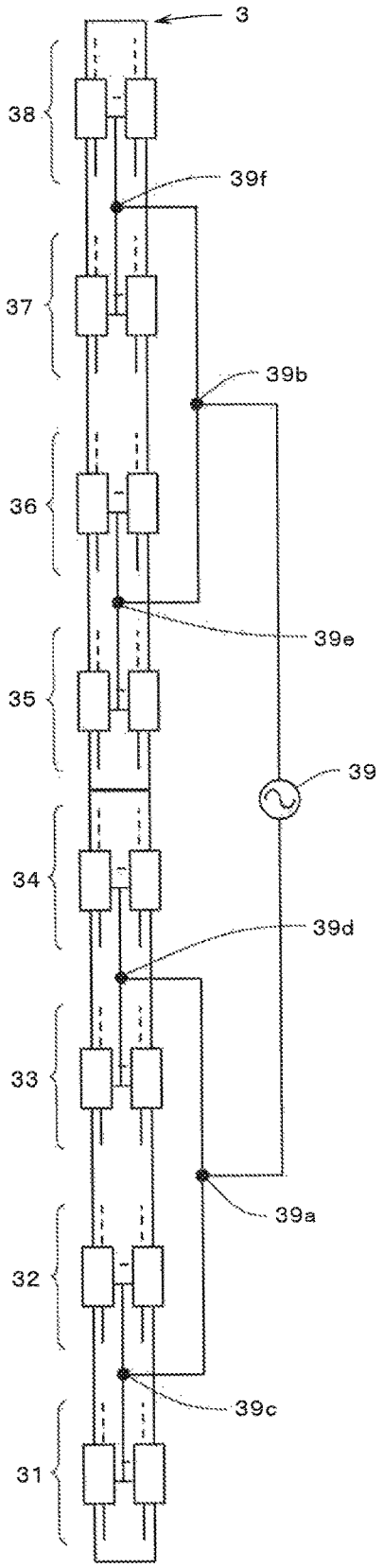
FIG. 10 shows the structure of a wideband antenna according to a third embodiment of this invention.

The structure of a wideband antenna 3 according to a third embodiment of this invention is shown in FIG. 10.

As shown in FIG. 10, the wideband antenna 3 of the third embodiment of this invention is formed by stacking unit elements in eight stages. Unit elements from a first-stage element 31 to an eight-stage element 38 each include two dipole antennas formed of two hot elements and two earth antennas and two parasitic elements each provided adjacent to a corresponding one of the dipole antennas in such a manner as to surround this dipole antenna. The unit element mentioned herein can be the first-stage element 11 (second-stage element 12) of the wideband antenna 1 according to the first embodiment or the first-stage element 21 (second-stage element 22) of the wideband antenna 2 according to the second embodiment. Specifically, the first-stage and second-stage elements 31 and 32 can be formed using the first-stage and second-stage elements 11 and 12 (first-stage and second-stage elements 21 and 22). Likewise, the third-stage and fourth-stage elements 33 and 34, the fifth-stage and sixth-stage elements 35 and 36, and the seventh-stage and eighth-stage elements 37 and 38 can be formed using the first-stage and second-stage elements 11 and 12 (first-stage and second-stage elements 21 and 22). Thus, the details of the structure of each stage will not be given.

In the wideband antenna 3 of the third embodiment, power from a feeding point 39 for the first to eighth stages is divided into two branches to be fed to a feeding point 39*a* for the first to fourth stages and a feeding point 39*b* for the fifth to eighth stages. Power from the feeding point 39*a* for the first to fourth stages is divided into two branches to be fed to a feeding point 39*c* for the first and second stages and a feeding point 39*d* for the third and fourth stages. Power from the feeding point 39*b* for the fifth to eighth stages is divided into two branches to be fed to a feeding point 39*e* for the fifth and sixth stages and a feeding point 39*f* for the seventh and eighth stages. In this way, the first-stage to eighth-stage elements 31 to 38 are fed in parallel with power distributed from the feeding point 39 for the first to eighth stages. If the wideband antenna 3 of the third embodiment of this invention having the stack in eight stages is placed in a standing posture in a vertical plane, a sharp radiation pattern can be formed in the vertical plane. Further, the unit element forming each stage broadens a frequency band, causing the wideband antenna 3 of the third embodiment to operate in a wide band.

Figure 11A:
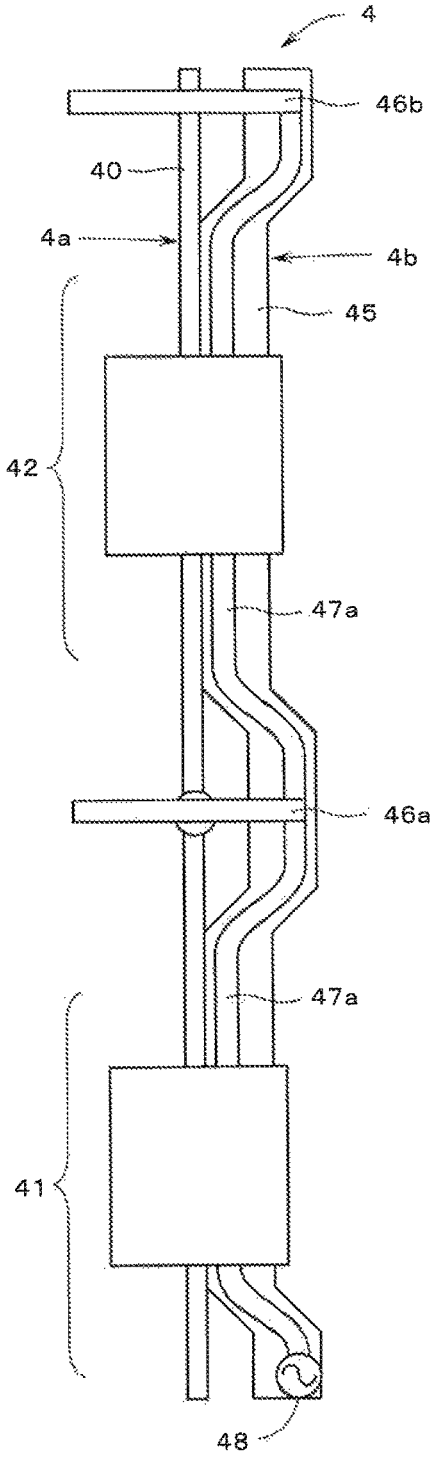
FIG. 11(*a*) is a front view showing the structure of a wideband antenna according to a fourth embodiment of this invention and FIG. 11(*b*) is a top view of FIG. 11(*a*).
Figure 11B:
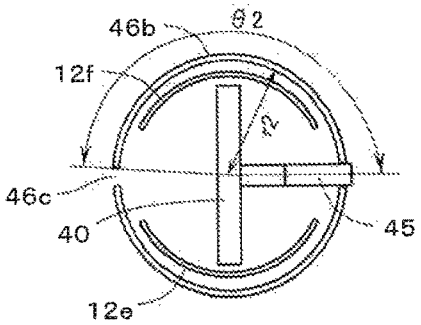
Figure 12:
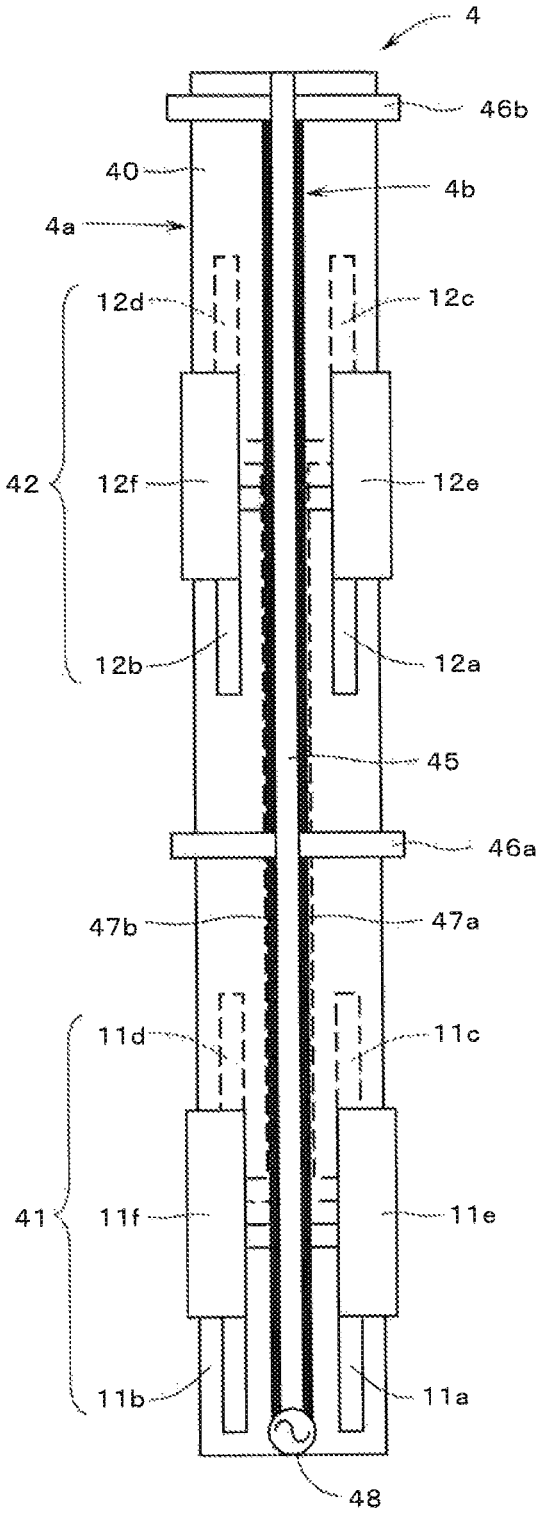
FIG. 12 is a side view showing the structure of the wideband antenna according to the fourth embodiment of this invention.
Figure 13:
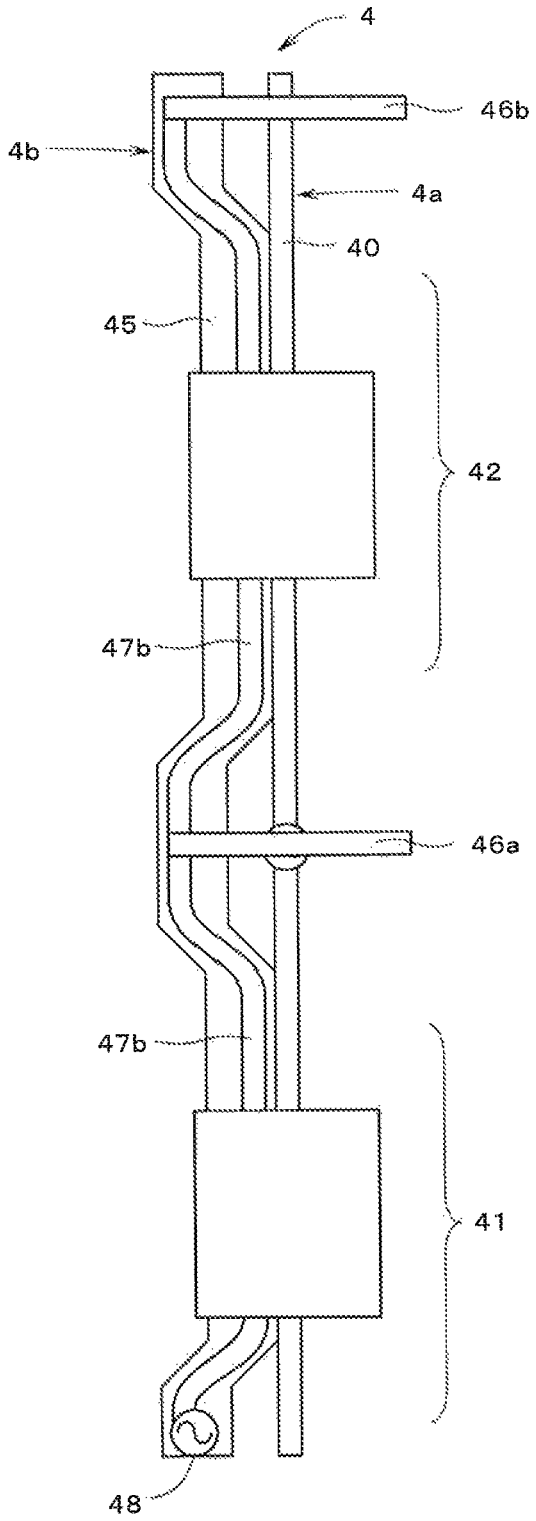
FIG. 13 is a back view showing the structure of the wideband antenna according to the fourth embodiment of this invention.

The structure of a wideband antenna 4 according to a fourth embodiment of this invention is shown in FIGS. 11, 12, and 13. FIG. 11(*a*) is a front view showing the structure of the wideband antenna 4 according to the fourth embodiment. FIG. 11(*b*) is a top view of FIG. 11(*a*). FIG. 12 is a side view showing the structure of the wideband antenna 4 according to the fourth embodiment. FIG. 13 is a back view showing the structure of the wideband antenna 4 according to the fourth embodiment.

As shown in these drawings, the wideband antenna 4 of the fourth embodiment of this invention includes a vertically polarized antenna 4*a* and a horizontally polarized antenna 4*b*. The vertically polarized antenna 4*a* has a stack of unit elements including a first vertically polarized element 41 and a second vertically polarized element 42. The first and second vertically polarized elements 41 and 42 can be formed using the unit elements of the wideband antenna 1 according to the first embodiment or using the unit elements of the wideband antenna 2 according to the second embodiment. The first and second vertically polarized elements 41 and 42 are formed on a substrate 40. The substrate 40 has a long and thin rectangular shape and for example is a fluorine resin substrate having favorable high-frequency characteristics.

The horizontally polarized antenna 4*b* is installed on a second substrate 45 disposed substantially perpendicular to the substrate 40. The second substrate 45 has a long and thin rectangular shape and for example is a fluorine resin substrate having favorable high-frequency characteristics. The second substrate 45 is wound outward at places separated by a given gap. A first horizontally polarized element 46*a* and a second horizontally polarized element 46*b* are provided at two places where the second substrate 45 is wound outward. A feeding line 47*a* for horizontal polarization and a feeding line 47*b* for horizontal polarization are formed on the front surface and the rear surface respectively of the second substrate 45. The first and second horizontally polarized elements 46*a* and 46*b* are placed between the first and second vertically polarized elements 41 and 42, located in a plane vertical to the long axis of the second substrate 45, and have the same C-shape. The first and second horizontally polarized elements 46*a* and 46*b* of the C-shape are each formed by bending a long and thin metal plate into an arc-like shape. As shown in FIG. 11(*b*), the first and second horizontally polarized elements 46*a* and 46*b* form a dipole antenna including two arc-like elements each having an are angle θ2 and a radius r2. Respective ends of the two arc-like elements on one side are each connected to the feeding lines 47*a* and 47*b* for horizontal polarization. Respective ends of these arc-like elements on the opposite side are opened and face each other with intervention of a gap 46*c*. The radius r2 exceeds the radius r1 of each of the parasitic elements 12*e* and 12*f* of the second vertically polarized element 42. A feeding point 48 for horizontal polarization is provided at the respective lower ends of the feeding lines 47*a* and 47*b* for horizontal polarization. The first and second horizontally polarized elements 46*a* and 46*b* are fed in series from the feeding point 48 for horizontal polarization through the feeding lines 47*a* and 47*b* for horizontal polarization. The horizontally polarized antenna 4*b* operates in a frequency band lower than an operating frequency band for the vertically polarized antenna 4*a* fed from the feeding point 48 for horizontal polarization. The length of each of the first and second horizontally polarized elements 46*a* and 46*b* is determined to be responsive to the operating frequency band for the first and second horizontally polarized elements 46*a* and 46*b*. For example, the are angle θ2 is set at about 169 degrees and the radius r2 is set at about 13.5 mm for the horizontally polarized elements 46*a* and 46*b*. The vertically polarized antenna 4*a*, to which the wideband antenna 1 of the first embodiment or the wideband antenna 2 of the second embodiment is applicable, operates in a wide band for the reason given above.

Figure 14A:
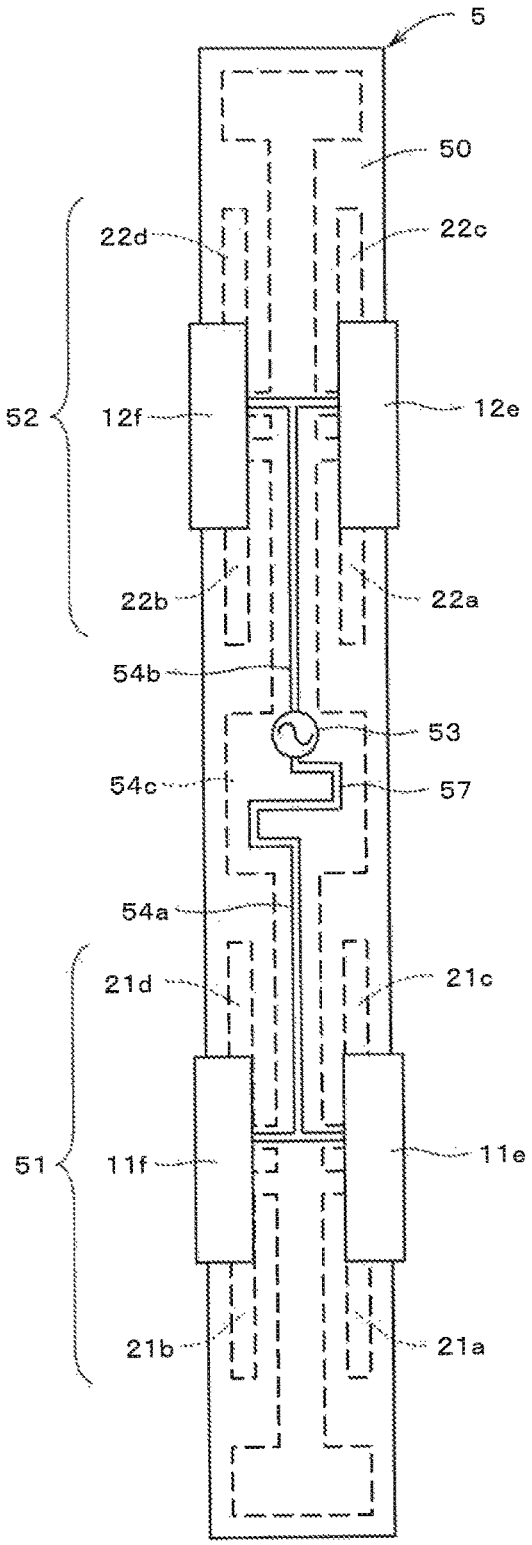
FIG. 14(*a*) is a front view showing the structure of a wideband antenna according to a fifth embodiment of this invention and FIG. 14(*b*) is a top view of FIG. 14(*a*).
Figure 14B:
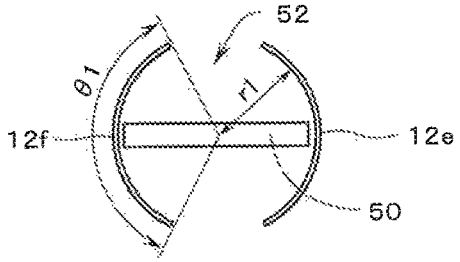
Figure 15:
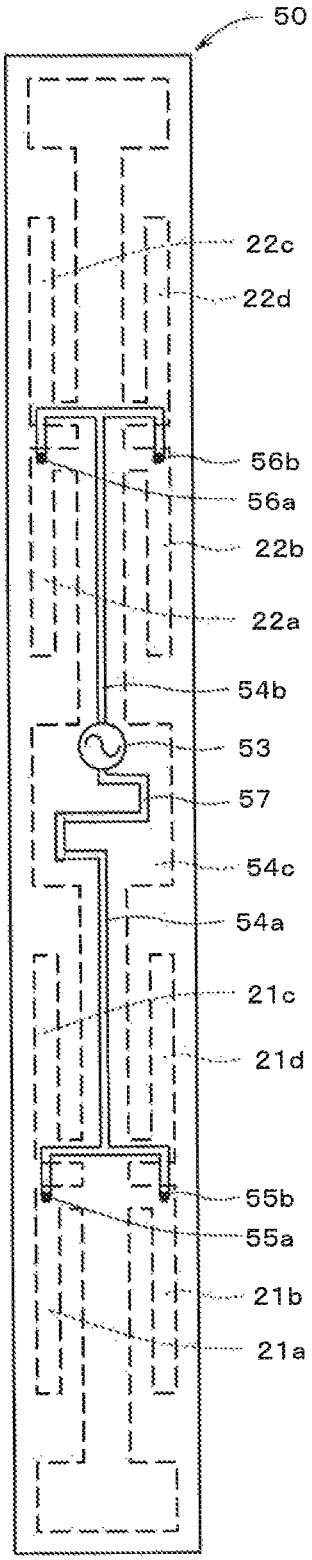
FIG. 15 is a back view showing the structure of the wideband antenna according to the fifth embodiment of this invention.

The structure of a wideband antenna 5 according to a fifth embodiment of this invention is shown in FIGS. 14 and 15. FIGS. 14(*a*) and 14(*b*) are a front view and a top view respectively showing the structure of the wideband antenna 5 according to the fifth embodiment. FIG. 15 is a back view showing the structure of the wideband antenna 5 according to the fifth embodiment.

As shown in these drawings, the wideband antenna 5 of the fifth embodiment of this invention is to tilt the radiation pattern formed by the wideband antenna 2 of the second embodiment of this invention. This is achieved by inserting a phase line 57 in a first branch line 54*a*.

The wideband antenna 5 of the fifth embodiment is described next in outline. The wideband antenna 5 includes the two hot elements 21*a* and 21*b* in a pair and the two earth elements 21*c* and 21*d* in a pair that form a first-stage element 51 as a unit element and extend along the opposite edges of the rear surface of a substrate 50 in the longitudinal direction. The substrate 50 has a long and thin rectangular shape and for example is a fluorine resin substrate having favorable high-frequency characteristics. The wideband antenna 5 further includes the two hot elements 22*a* and 22*b* in a pair and the two earth elements 22*c* and 22*d* in a pair that form a second-stage element 52 as a unit element and extend along the opposite edges of the rear surface of the substrate 50 in the longitudinal direction. The hot elements 21*a*, 21*b*, 22*a*, and 22*b* have their shapes described in relation to the wideband antenna 2 of the second embodiment. The earth elements 21*c*, 21*d*, 22*c*, and 22*d* have their shapes described in relation to the wideband antenna 2 of the second embodiment. In the first-stage element 51, the arc-like parasitic element 11*e* is provided adjacent to a dipole antenna formed of the hot element 21*a* and the earth element 21*c* in such a manner as to surround this dipole antenna. The arc-like parasitic element 11*f* is provided adjacent to a dipole antenna formed of the hot element 21*b* and the earth element 21*d* in such a manner as to surround this dipole antenna. In the second-stage element 52, the arc-like parasitic element 12*e* is provided adjacent to a dipole antenna formed of the hot element 22*a* and the earth element 22*c* in such a manner as to surround this dipole antenna. The arc-like parasitic element 12*f* is provided adjacent to a dipole antenna formed of the hot element 22*b* and the earth element 22*d* in such a manner as to surround this dipole antenna. As described above in relation to the wideband antenna 1 of the first embodiment, the parasitic elements 11*e*, 11*f*, 12*e*, and 12*f* have the radius r1 and the arc angle θ1.

A feeding point 53 is arranged in a position slightly above a substantially central part of the substrate 50. The first branch line 54*a* including the interposed phase line 57 and a second branch line 54*b* are connected to a hot side of the feeding point 53 and formed on the front surface of the substrate 50 in such a manner as to extend upward and downward substantially along the center line of the front surface in the longitudinal direction. The phase line 57 is wound in a meander shape. Alternatively, the phase line 57 may be formed of a distributed constant line or a concentrated constant line. The first branch line 54*a* extending downward from the feeding point 53 through the phase line 57 has a tip formed into a T-shape. A portion of the first branch line 54*a* extending further from the T-shape portion is bent downward and the respective tips of the bent portions are connected to the hot elements 21*a* and 21*b* of the first-stage element 51 through a through hole 55*a* and a through hole 55*b* respectively. The second branch line 54*b* extending upward from the feeding point 53 has a tip formed into a T-shape. A portion of the second branch line 54*b* extending further from the T-shape portion is bent downward and the respective tips of the bent portions are connected to the hot elements 22*a* and 22*b* of the second-stage element 52 through a through hole 56*a* and a through hole 56*b* respectively. A wide earth line 54*c* connected to an earth side of the feeding point 53 is formed on the rear surface of the substrate 50 in such a manner as to extend upward and downward substantially along the center line of the rear surface in the longitudinal direction. The earth line 54*c* extending downward from the feeding point 53 is connected to respective end portions of the earth elements 21*c* and 21*d* of the first-stage element 51 bent into an L-shape in such a manner that the respective lower portions of the earth elements 21*c* and 21*d* face each other. The earth line 54*c* extending upward from the feeding point 53 is connected to the earth elements 22*c* and 22*d* of the second-stage element 52 bent into an L-shape in such a manner that the respective lower portions of the earth elements 22*c* and 22*d* face each other. In this way, the first-stage and second-stage elements 51 and 52 are fed from the feeding point 53 through a transmission line including the first branch line 54*a* with the interposed phase line 57, the second branch line 54*b*, and the earth line 54*c*.

The phase line 57 and the first and second branch lines 54*a* and 54*b* formed on the front surface of the substrate 50 extend over the wide earth line 54*c* formed on the rear surface of the substrate 50 and the aforementioned transmission line functions as a stripline. The first-stage and second-stage elements 51 and 52 are fed in parallel from the feeding point 53 through the stripline. The feed of the first-stage element 51 is delayed only by the phase amount of the phase line 57, compared to the second-stage element 52. As a result, if the wideband antenna 5 of the fifth embodiment is placed in a standing posture in a vertical plane, a radiation pattern is tilted downward in response to the phase amount of the phase line 57.

In the wideband antenna 5 of the fifth embodiment of this invention, the two dipole antennas formed of the hot elements 21*a* and 21*b* and the earth elements 21*c* and 21*d* of the first-stage element 51 function as a vertically polarized antenna. Further, the two dipole antennas formed of the hot elements 22*a* and 22*b* and the earth elements 22*c* and 22*d* of the second-stage element 52 function as a vertically polarized antenna. The dimensions of the wideband antenna 5 according to the fifth embodiment are the same as corresponding dimensions of the wideband antenna 2 according to the second embodiment. The position of the first-stage element 51 and that of the second-stage element 52 relative to each other are the same as the position of the first-stage element 21 and that of the second-stage element 22 relative to each other. As a result, a voltage standing wave ratio (VSWR) of about 1.5 or less can be obtained in a frequency band from about 2500 to about 2650 MHz.

Figure 16:
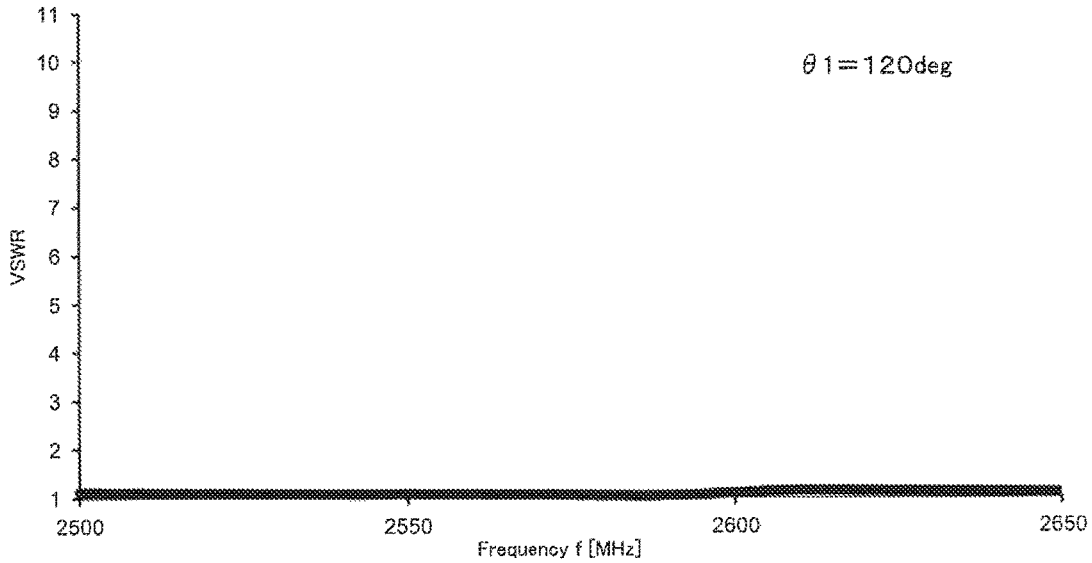
FIG. 16 shows the frequency characteristics of a VSWR in a vertically polarized wave with an arc angle set at about 120 degrees in a wideband antenna according to a sixth embodiment of this invention.
Figure 17:
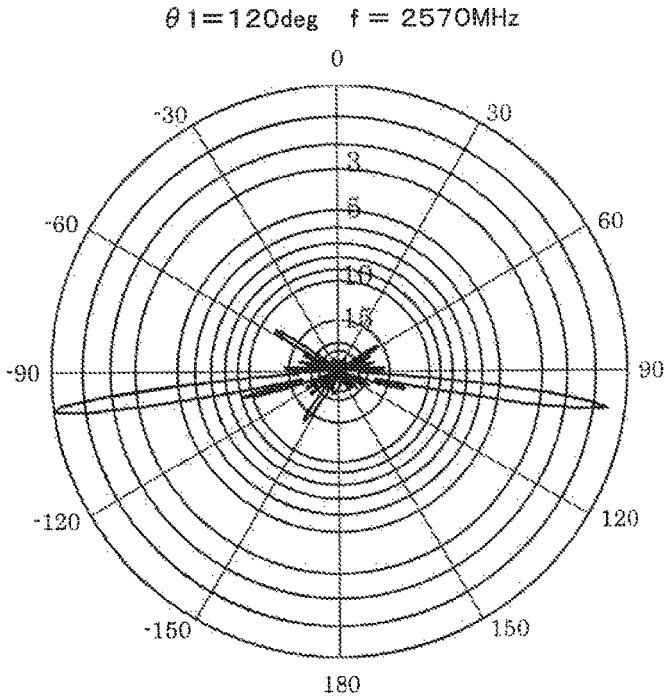
FIG. 17 shows the radiation pattern of a vertically polarized wave in a vertical plane with the arc angle set at about 120 degrees in the wideband antenna according to the sixth embodiment of this invention.
Figure 18:
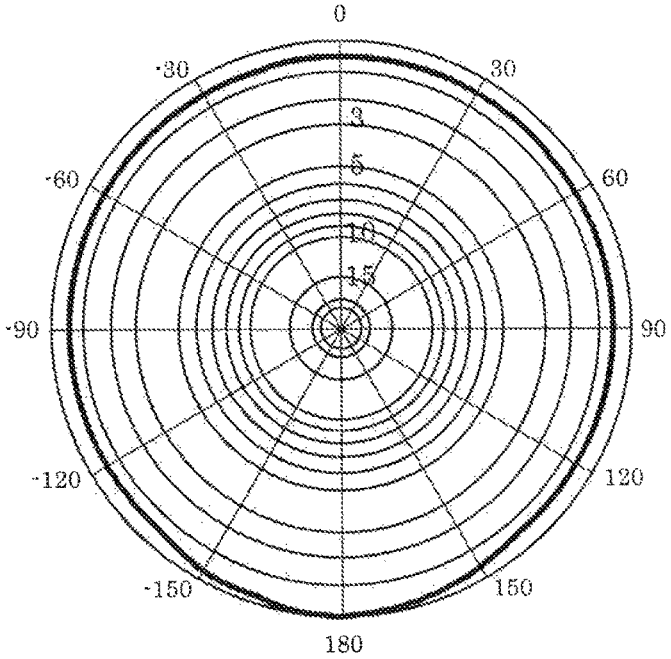
FIG. 18 shows the radiation pattern of a vertically polarized wave in a horizontal plane with the arc angle set at about 120 degrees in the wideband antenna according to the sixth embodiment of this invention.
Figure 19:
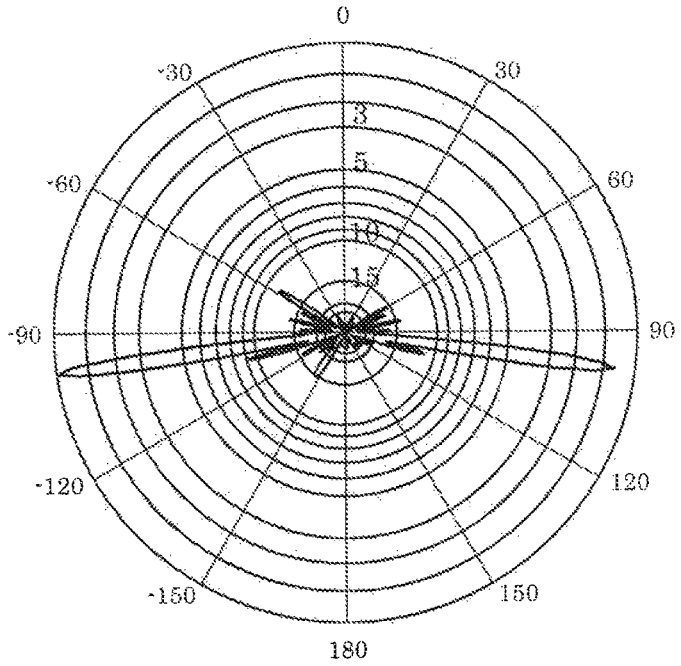
FIG. 19 shows the radiation pattern of a vertically polarized wave in a vertical plane with the arc angle set at about 90 degrees in the wideband antenna according to the sixth embodiment of this invention.
Figure 20:
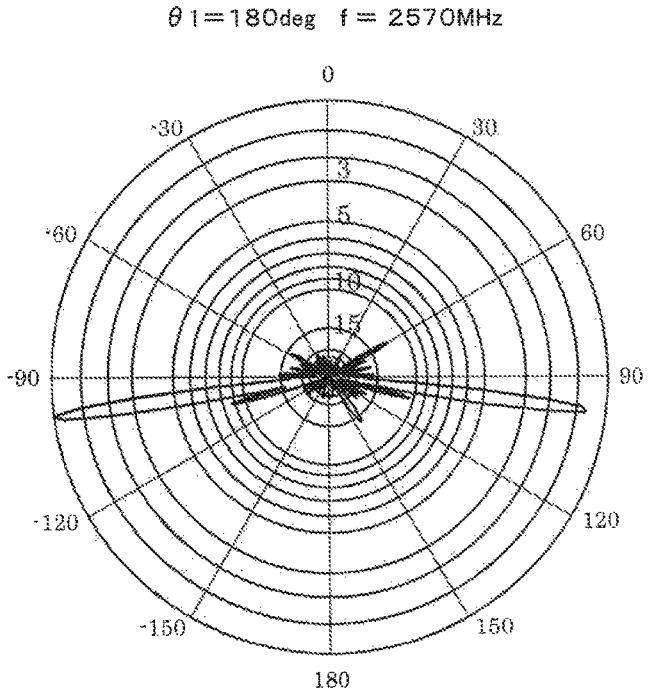
FIG. 20 shows the radiation pattern of a vertically polarized wave in a vertical plane with the arc angle set at about 180 degrees in the wideband antenna according to the sixth embodiment of this invention.
Figure 21:
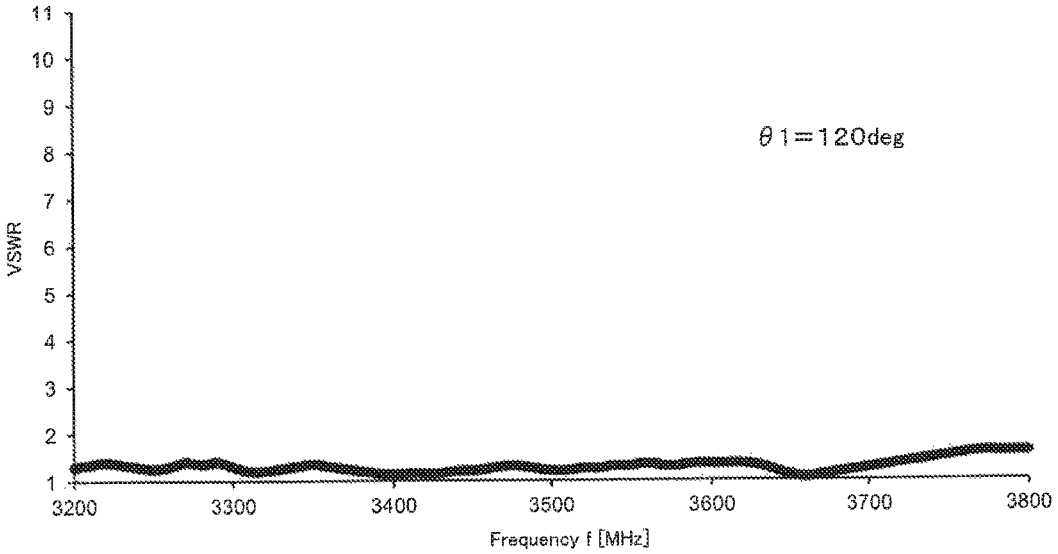
FIG. 21 shows different frequency characteristics of a VSWR in a vertically polarized wave with the arc angle set at about 120 degrees in the wideband antenna according to the sixth embodiment of this invention.
Figure 22:
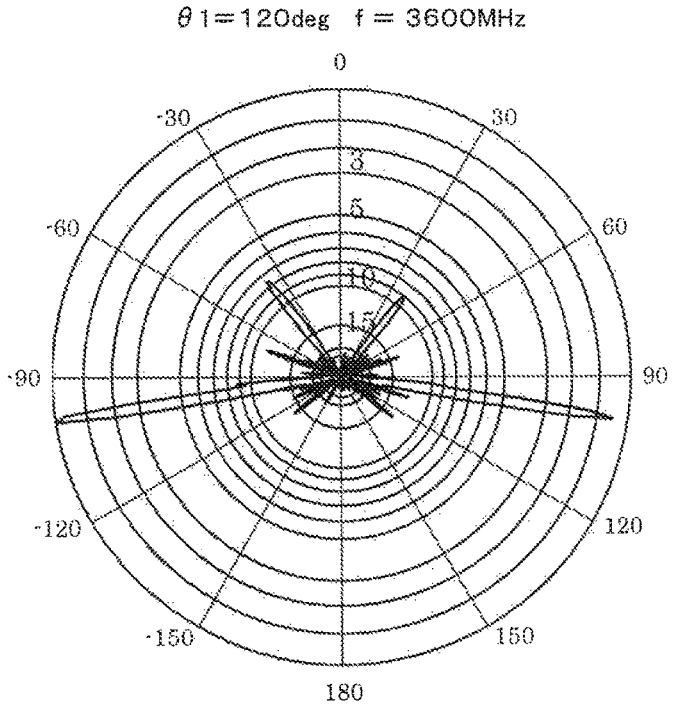
FIG. 22 shows the radiation pattern of a vertically polarized wave in a vertical plane with the arc angle set at about 120 degrees in the wideband antenna according to the sixth embodiment of this invention.
Figure 23:
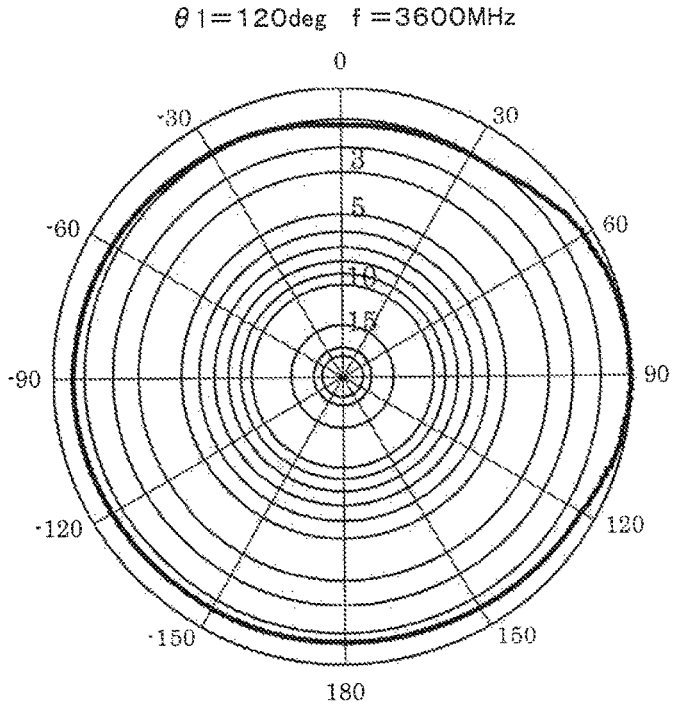
FIG. 23 shows the radiation pattern of a vertically polarized wave in a horizontal plane with the arc angle set at about 120 degrees in the wideband antenna according to the sixth embodiment of this invention.

The antenna characteristics of the wideband antenna according to this invention are shown in FIGS. 16 to 23. The antenna characteristics shown in these drawings correspond to the antenna characteristics of a wideband antenna 6 of a sixth embodiment formed by stacking the unit elements in the wideband antenna 5 of the fifth embodiment of this invention in 16 stages. The wideband antenna 6 is placed in a standing posture in a vertical plane. FIG. 16 shows the frequency characteristics of a VSWR in the wideband antenna 6. FIG. 17 shows a radiation pattern in a vertical plane with the arc angle θ1 set at about 120 degrees for a parasitic element of a unit element and a frequency at 2570 MHz. FIG. 18 shows a radiation pattern in a horizontal plane with the arc angle θ1 set at about 120 degrees for the parasitic element of the unit element and a frequency at 2570 MHz. FIG. 19 shows a radiation pattern in a vertical plane with the arc angle θ1 set at about 90 degrees for the parasitic element of the unit element and a frequency at 2570 MHz. FIG. 20 shows a radiation pattern in a vertical plane with the arc angle θ1 set at about 180 degrees for the parasitic element of the unit element and a frequency at 2570 MHz. FIG. 21 shows different frequency characteristics of a VSWR in the wideband antenna 6. FIG. 22 shows a radiation pattern in a vertical plane with the arc angle θ1 set at about 120 degrees for the parasitic element of the unit element and a frequency at 3600 MHz. FIG. 23 shows a radiation pattern in a horizontal plane with the arc angle θ1 set at about 120 degrees for the parasitic element of the unit element and a frequency at 3600 MHz.

By referring to FIG. 16, with the arc angle θ1 is set at about 120 degrees, a favorable VSWR of about 1.5 or less can be obtained in a 2.5 GHz frequency band from 2500 to 2650 MHz. The center frequency f0 of this frequency band is 2575 MHz. The radiation pattern shown in FIG. 17 is normalized along the outermost periphery of the graph. Reference to FIG. 17 shows that with a frequency set at 2570 MHz and the arc angle θ1 at about 120 degrees, a sharp radiation pattern having a half-value angle of about 4 degrees is formed and the radiation pattern has a peak in a direction tilted downward about eight degrees from a horizontal plane. Reference to FIG. 18 shows that with a frequency set at 2570 MHz and the arc angle θ1 at about 120 degrees, omnidirectional characteristics are achieved with a deviation of about 0.5 dB between a maximum and a minimum of a radiation pattern in a horizontal plane. Reference to FIG. 19 shows that with a frequency set at 2570 MHz and the arc angle θ1 at about 90 degrees, a sharp radiation pattern having a half-value angle of about 5 degrees is formed and the radiation pattern has a peak in a direction tilted downward about eight degrees from a horizontal plane. The radiation pattern has a slight difference of about −0.6 dB between a direction of about 98 degrees and a direction of about −98 degrees. Reference to FIG. 20 shows that with a frequency set at 2570 MHz and the arc angle θ1 at about 180 degrees, a sharp radiation pattern having a half-value angle of about 4 degrees is formed and the radiation pattern has a peak in a direction tilted downward about eight degrees from a horizontal plane. The radiation pattern has a slight difference of about −0.7 dB between a direction of about 98 degrees and a direction of about −98 degrees.

By referring to FIG. 21, with the arc angle θ1 set at about 120 degrees, a favorable VSWR of about 1.5 or less can be obtained in a 3.5 GHz frequency band from 3200 to 3750 MHz. The center frequency f0 of this frequency band is 3475 MHz. The radiation pattern shown in FIG. 22 is normalized along the outermost periphery of the graph. Reference to FIG. 22 shows that with a frequency set at 3600 MHz and the arc angle θ1 at about 120 degrees, a sharp radiation pattern having a half-value angle of about 3 or 4 degrees is formed and the radiation pattern has a peak in a direction tilted downward about eight degrees from a horizontal plane. Reference to FIG. 23 shows that with a frequency set at 3600 MHz and the arc angle θ1 at about 120 degrees, omnidirectional characteristics are achieved with a deviation of about 1.0 dB between a maximum and a minimum of a radiation pattern in a horizontal plane.

The wideband antenna 6 of the sixth embodiment is a vertically polarized antenna and a wideband antenna to operate in a 2.5 GHz band and a 3.5 GHz band as described above. This wideband antenna broadens a frequency band as a result of the presence of parasitic elements provided adjacent to corresponding ones of two dipole antennas of a unit element in each stage in such a manner as to surround these dipole antennas. Even if the arc angle θ1 of the parasitic element in the wideband antenna 6 according to the sixth embodiment is reduced to about 90 degrees or increased to about 180 degrees, antenna characteristics comparable to those with the arc angle θ1 of about 120 degrees are still obtained. This shows that in the wideband antenna of this invention, the arc angle of the parasitic element can be set in a range from about 90 to about 180 degrees. If the are angle θ1 is set at about 180 degrees, parasitic elements are disposed in such a manner as to avoid contact between respective end portions of the parasitic elements.

Figure 24:
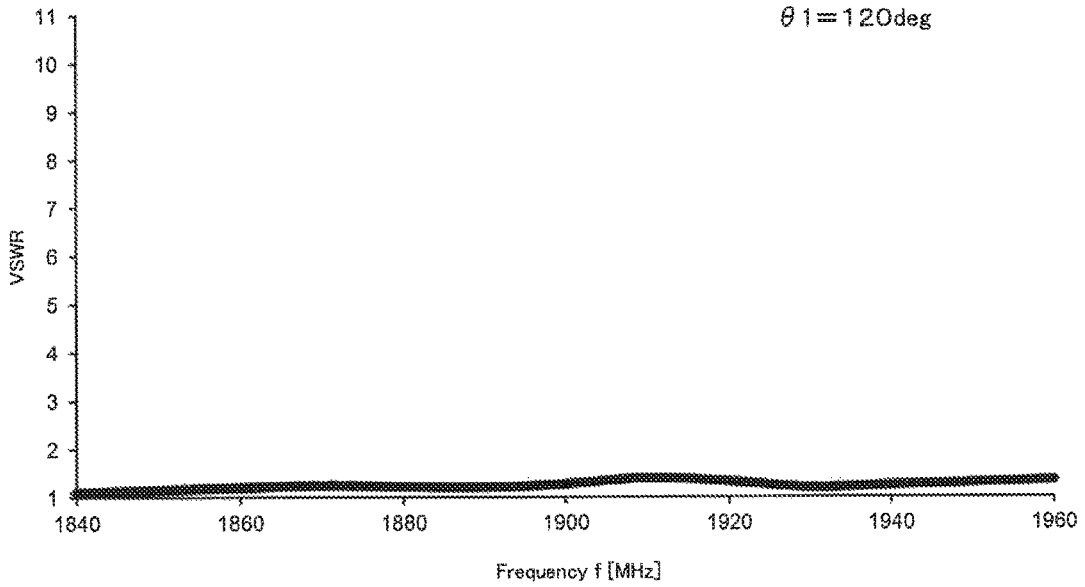
FIG. 24 shows the frequency characteristics of a VSWR in a horizontally polarized wave with an arc angle set at about 120 degrees in a wideband antenna according to a seventh embodiment of this invention.
Figure 25:
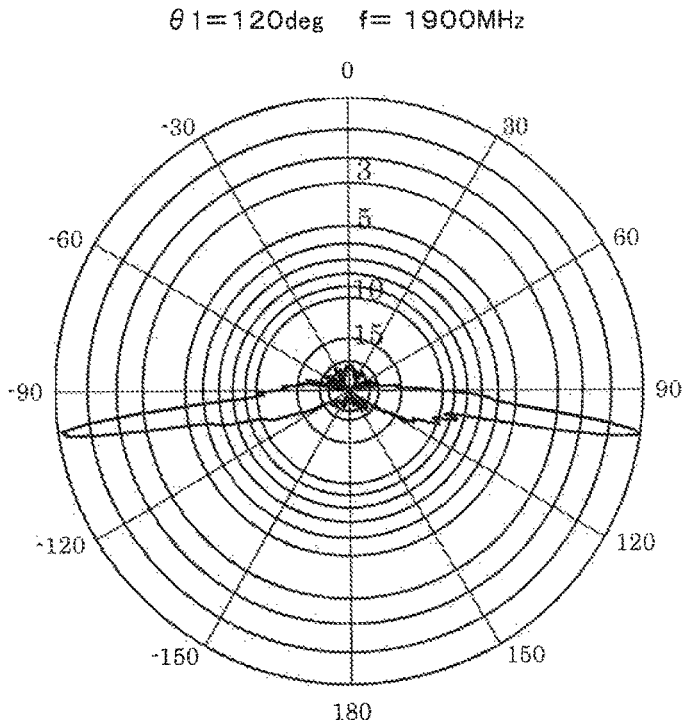
FIG. 25 shows the radiation pattern of a horizontally polarized wave in a vertical plane with the arc angle set at about 120 degrees in the wideband antenna according to the seventh embodiment of this invention.
Figure 26:
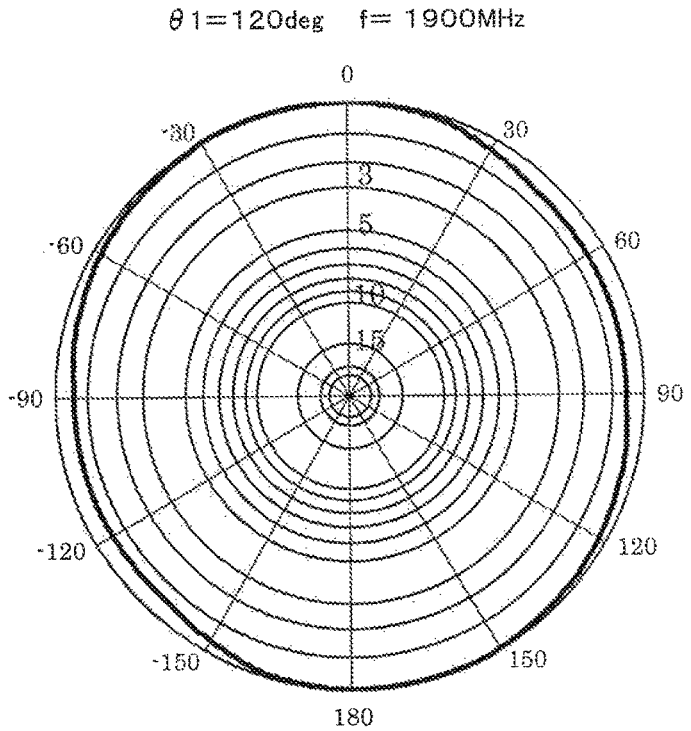
FIG. 26 shows the radiation pattern of a horizontally polarized wave in a horizontal plane with the arc angle set at about 120 degrees in the wideband antenna according to the seventh embodiment of this invention.
Figure 27:
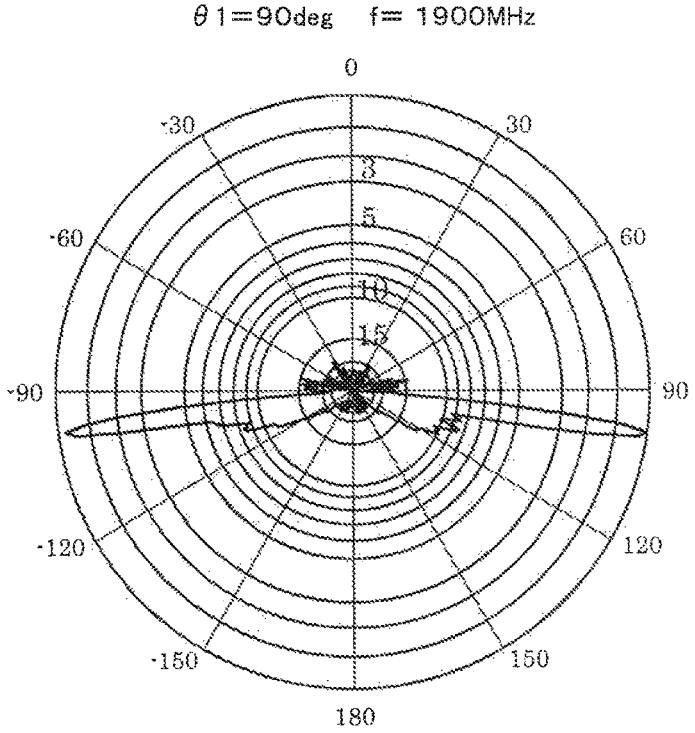
FIG. 27 shows the radiation pattern of a horizontally polarized wave in a vertical plane with the arc angle set at about 90 degrees in the wideband antenna according to the seventh embodiment of this invention.
Figure 28:
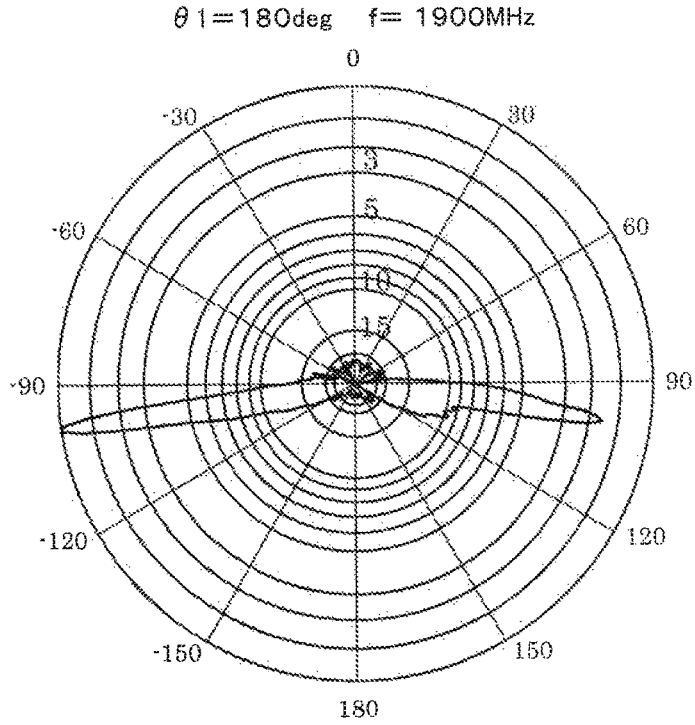
FIG. 28 shows the radiation pattern of a horizontally polarized wave in a vertical plane with the arc angle set at about 180 degrees in the wideband antenna according to the seventh embodiment of this invention.

FIGS. 24 to 28 show the antenna characteristics of a wideband antenna 7 according to a seventh embodiment is formed by providing the horizontally polarized antenna 4*b* of the wideband antenna 4 according to the fourth embodiment to the wideband antenna 5 as a vertically polarized antenna according to the fifth embodiment of this invention. Specifically, the wideband antenna 7 of the seventh embodiment includes a vertically polarized antenna and a horizontally polarized antenna. Horizontally polarized elements are stacked in 20 stages and fed in series. The horizontally polarized elements in 20 stages are fed in out of phase with each other so as to tit a radiation pattern downward. The horizontally polarized elements have the arc angle θ2 of about 169 degrees and the radius r2 of about 13.5 mm. FIG. 24 shows the frequency characteristics of a VSWR in the horizontally polarized antenna of the wideband antenna 7. FIG. 25 shows the radiation pattern of the horizontally polarized antenna in a vertical plane with the arc angle θ1 set at about 120 degrees for a parasitic element of the vertically polarized antenna of the wideband antenna 7 and a frequency at 1900 MHz. FIG. 26 shows the radiation pattern of the horizontally polarized antenna in a horizontal plane with the arc angle θ1 set at about 120 degrees for the parasitic element of the vertically polarized antenna of the wideband antenna 7 and a frequency at 1900 MHz. FIG. 27 shows the radiation pattern of the horizontally polarized antenna in a vertical plane with the arc angle θ1 set at about 90 degrees for the parasitic element of the vertically polarized antenna of the wideband antenna 7 and a frequency at 1900 MHz. FIG. 28 shows the radiation pattern of the horizontally polarized antenna in a vertical plane with the arc angle θ1 set at about 180 degrees for the parasitic element of the vertically polarized antenna of the wideband antenna 7 and a frequency at 1900 MHz.

By referring to FIG. 24, a favorable VSWR of about 1.5 or less can be obtained in a 1.9 GHz frequency band from 1840 to 1960 MHz. The center frequency f0 of this frequency band is 1900 MHz. The radiation pattern shown in FIG. 25 is normalized along the outermost periphery of the graph. Reference to FIG. 25 shows that with a frequency set at 1900 MHz and the arc angle θ1 at about 120 degrees, a sharp radiation pattern having a half-value angle of about 5 degrees is formed and the radiation pattern has a peak in a direction tilted downward about eight degrees from a horizontal plane. Reference to FIG. 26 shows that with a frequency set at 1900 MHz and the arc angle θ1 at about 120 degrees, omnidirectional characteristics are achieved with a deviation of about 0.6 dB between a maximum and a minimum of a radiation pattern in a horizontal plane. Reference to FIG. 27 shows that with a frequency set at 1900 MHz and the arc angle θ1 at about 90 degrees, a sharp radiation pattern having a half-value angle of about 5 degrees is formed and the radiation pattern has a peak in a direction tilted downward about eight degrees from a horizontal plane. The radiation pattern has a slight difference of about −0.2 dB between a direction of about 98 degrees and a direction of about −98 degrees. Reference to FIG. 28 shows that with a frequency set at 1900 MHz and the arc angle θ1 at about 180 degrees, a sharp radiation pattern having a half-value angle of about 4 degrees is formed and the radiation pattern has a peak in a direction tilted downward about eight degrees from a horizontal plane. The radiation pattern has a difference of about −1.8 dB between a direction of about 98 degrees and a direction of about −98 degrees.

As understood from above, electromagnetic coupling occurs between the parasitic element of the vertically polarized antenna and the C-shape horizontally polarized element in some cases in a manner that depends on the arc angle θ1 of the parasitic element of the vertically polarized antenna of the wideband antenna 7 to affect antenna characteristics. If the arc angle θ1 of the parasitic element is less than about 180 degrees, the electromagnetic coupling between the parasitic element of the vertically polarized antenna and the C-shape horizontally polarized element does not cause serious effect. Thus, by setting the arc angle θ1 of the parasitic element at about 90 degrees or more and less than about 180 degrees, a high-performance radiation pattern of the horizontally polarized antenna can be maintained.

Figure 29:
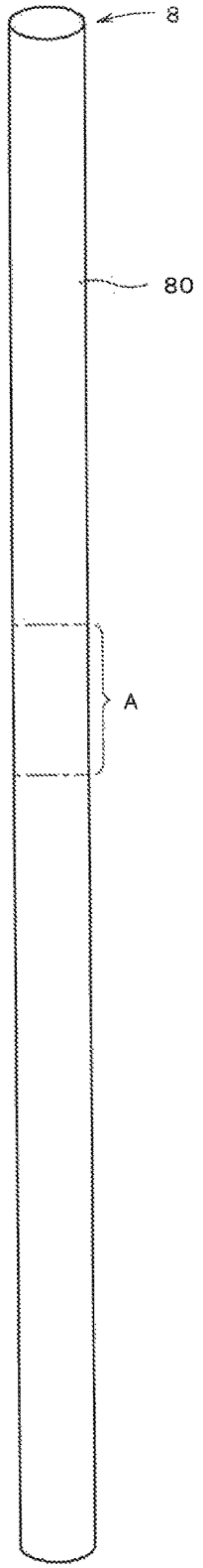
FIG. 29 shows the structure of a wideband antenna according to an eighth embodiment of this invention.
Figure 30A:
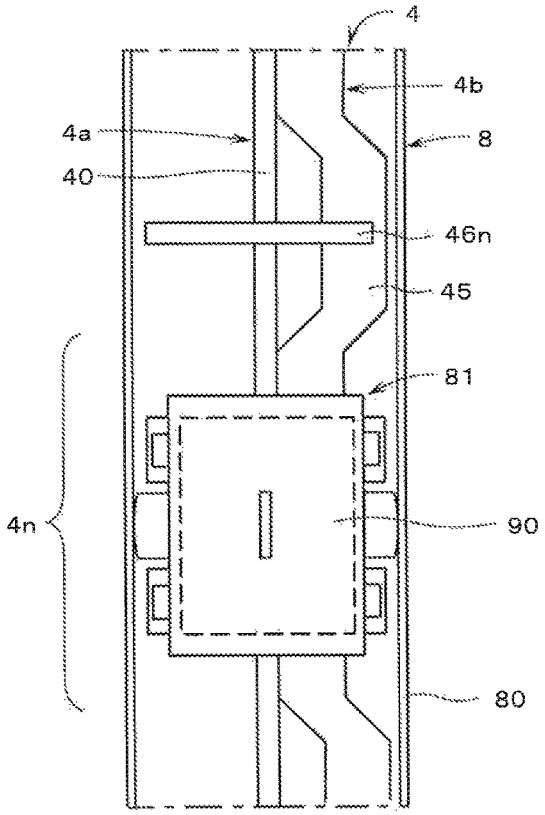
FIG. 30(*a*) is a front view showing the cross section of the structure of a part A of the wideband antenna in an enlarged manner according to the eighth embodiment of this invention and FIG. 30(*b*) is a side view showing the cross section of the structure of the part A in an enlarged manner.
Figure 30B:
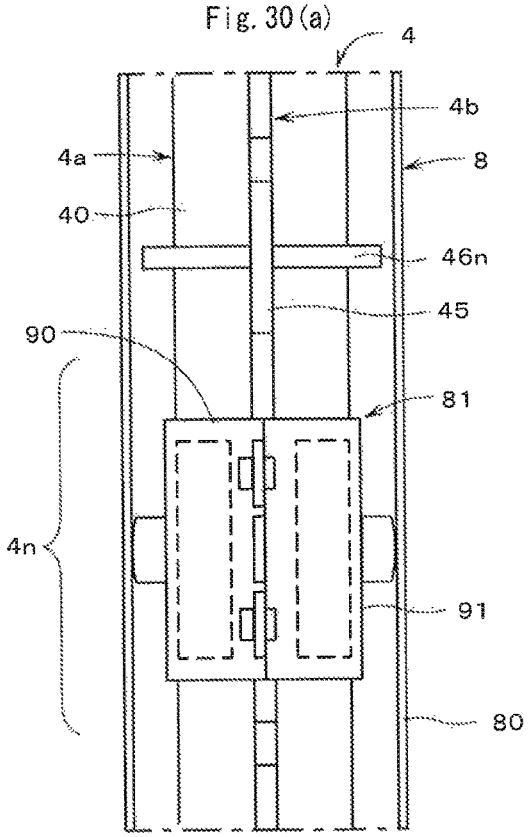
Figure 31:
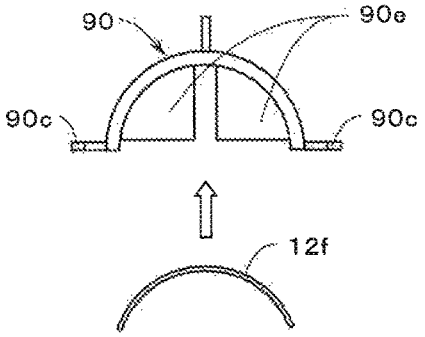
FIGS. 31(*a*)-31(*d*) show steps of assembling the wideband antenna according to the eighth embodiment of this invention.
Figure 31:
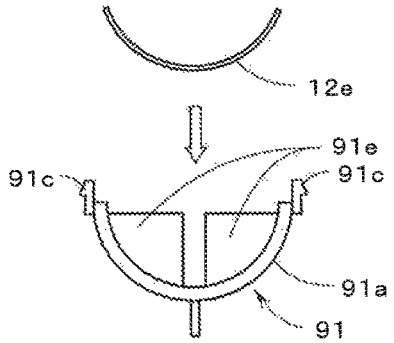
Figure 31:
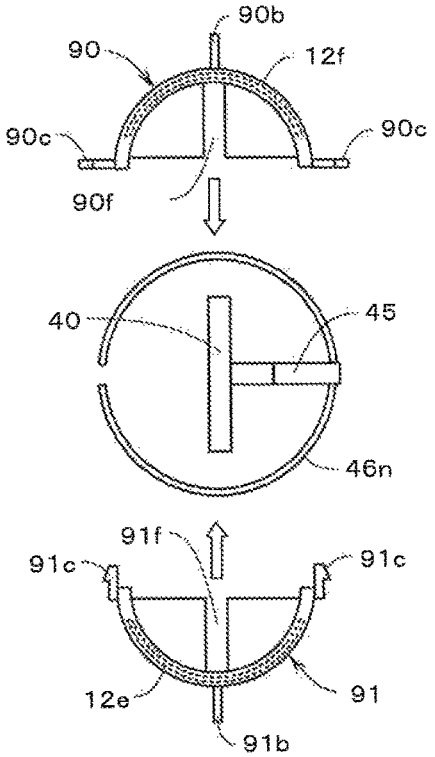
Figure 31:
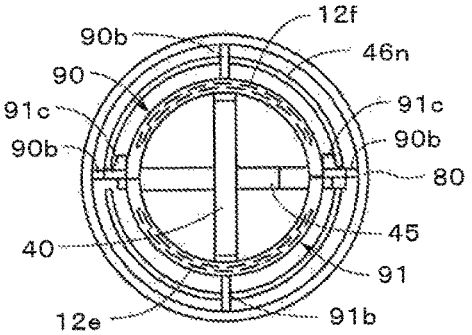
Figure 32A:
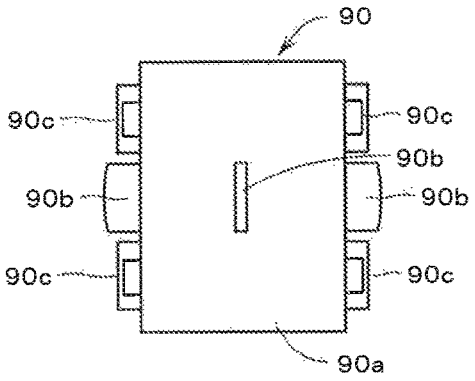
FIGS. 32(*a*), 32(*b*), 32(*c*), and 32(*d*) are a front view, a back view, a side view, and a bottom view respectively showing the structure of a first spacer of the wideband antenna according to the eighth embodiment of this invention.
Figure 32B:
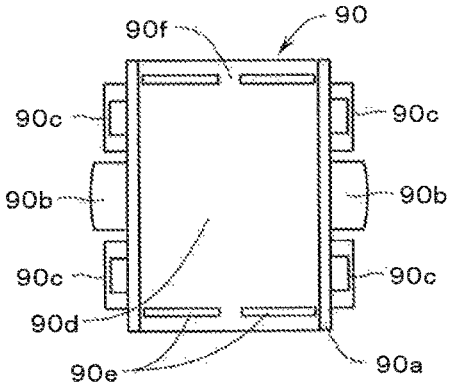
Figure 32C:
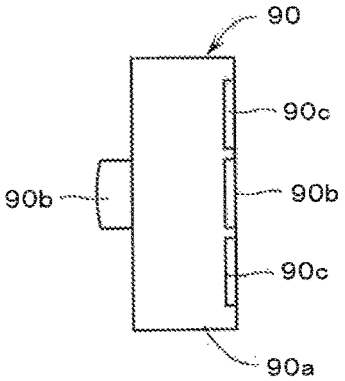
Figure 32D:
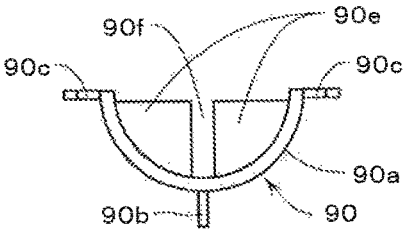
Figure 33A:
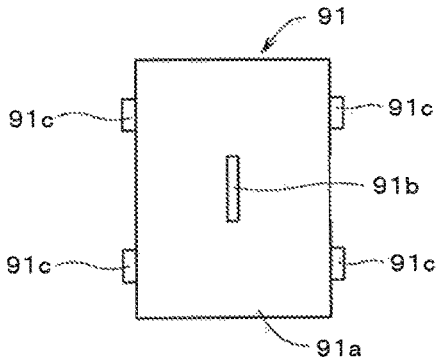
FIGS. 33(*a*), 33(*b*), 33(*c*), and 33(*d*) are a front view, a back view, a side view, and a bottom view respectively showing the structure of a second spacer of the wideband antenna according to the eighth embodiment of this invention.
Figure 33B:
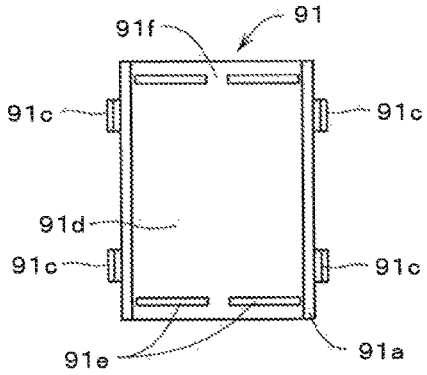
Figure 33C:
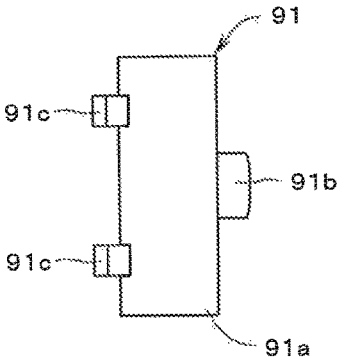
Figure 33D:
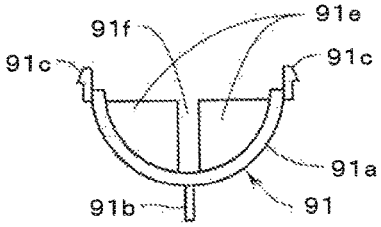

FIG. 29 shows the structure of a wideband antenna 8 according to an eighth embodiment of this invention. FIG. 30(*a*) is a front view showing the cross section of a part A of the wideband antenna 8 in an enlarged manner. FIG. 30(*b*) is a side view showing the cross section of the part A in an enlarged manner. FIGS. 31(*a*) to 31(*d*) show steps of assembling the wideband antenna 8 according to the eighth embodiment. FIGS. 32(*a*) to 32(*d*) show the structure of a first spacer 90 of the wideband antenna 8 according to the eighth embodiment. FIGS. 33(*a*) to 33(*d*) show the structure of a second spacer 91 of the wideband antenna 8 according to the eighth embodiment.

The wideband antenna 8 of the eighth embodiment of this invention includes a cylindrical case 80 like a cylinder of a small diameter shown in FIG. 29. The cylindrical case 80 is made of synthetic resin having a relative permittivity close to 1 and favorable permeability to an electromagnetic wave. The cylindrical case 80 houses a wideband antenna formed by stacking the vertically polarized elements and the horizontally polarized elements of the wideband antenna 4 according to the fourth embodiment in multiple stages. The number of the stages of the stack is preferably from eight to 18. Specifically, the substrate 40 provided with the vertically polarized elements in stages from 15 to 25 and the second substrate 45 provided with the horizontally polarized elements in stages from 15 to 25 are housed in the cylindrical case 80 to be substantially perpendicular to each other.

As shown in FIGS. 30(*a*) and 30(*b*), the wideband antenna 8 of the eighth embodiment has a characteristic structure where a parasitic element part 81 to hold a parasitic element in a given position also functions as a fixing tool with which the substrate 40 and the second substrate 45 are attached to be substantially perpendicular to each other. The parasitic element part 81 is formed of a first spacer 90 and a second spacer 91 each having a semicircular shape corresponding to a half of a cylinder. The first and second spacers 90 and 91 are made of synthetic resin having favorable permeability to an electromagnetic wave.

FIGS. 32(*a*), 32(*b*), 32(*c*), and 32(*d*) are a front view, a back view, a side view, and a bottom view respectively showing the structure of the first spacer 90. As shown in these drawings, the first spacer 90 has a semicircular shape corresponding to a half of a cylinder. The first spacer 90 has housing space 90*d* inside to house an arc-like parasitic element. An upper insertion portion 90*c* and a lower insertion portion 90*c* in a pair are formed to project from an outer circumferential surface at each of the right and left edges. A rectangular guide strip 90*b* having a rounded tip surface is formed to project from a position between the insertion portions 90*c* in a pair. The guide strip 90*b* is also formed to project from a substantially central part of the outer circumferential surface. The insertion portions 90*c* are each formed into a portal shape having a rectangular insertion hole. A semicircular upright strip 90*e* is formed in a position on the inner circumferential surface of the first spacer 90 slightly below the upper surface of the first spacer 90. The upright strip 90*e* is also formed in a position on the inner circumferential surface slightly above the lower surface of the first spacer 90. In this way, the housing space 90*d* is closed from above and below with the upright strips 90*e*. This prevents an arc-like parasitic element from falling off the first spacer 90 when the parasitic element is housed in the housing space 90*d*. A groove portion 90*f* having a width substantially the same as the thickness of the second substrate 45 is formed in a substantially central part of the upright strip 90*e*.

FIGS. 33(*a*), 33(*b*), 33(*c*), and 33(*d*) are a front view, a back view, a side view, and a bottom view respectively showing the structure of the second spacer 91. As shown in these drawings, the second spacer 91 has a semicircular shape corresponding to a half of a cylinder. The second spacer 91 has housing space 91*d* inside to house an arc-like parasitic element. An upper engagement strip 91*c* and a lower engagement strip 91*c* in a pair are formed to project in tangential directions from an outer circumferential surface at each of the right and left edges. A rectangular guide strip 91*b* having a rounded tip surface is formed to project from a substantially central position of the outer circumferential surface. The engagement strip 91*c* is to be inserted in the insertion hole of the insertion portion 90*c* when the first and second spacers 90 and 91 are fitted to each other. To facilitate the insertion, the engagement strip 91*c* has a slanting tip surface. For retention of the engagement strip 91*c*, a stepped portion is formed continuously with the slanting surface. A semicircular upright strip 91*e* is formed in a position on the inner circumferential surface of the second spacer 91 slightly below the upper surface of the second spacer 91. The upright strip 91*e* is also formed in a position on the inner circumferential surface slightly above the lower surface of the second spacer 91. In this way, the housing space 91*d* is closed from above and below with the upright strips 91*e*. This prevents an arc-like parasitic element from falling off the second spacer 91 when the parasitic element is housed in the housing space 91*d*. A groove portion 91*f* having a width substantially the same as the thickness of the second substrate 45 is formed in a substantially central part of the upright strip 91*e*.

Steps of assembling the wideband antenna 8 of the eighth embodiment are described next. First, as shown in FIG. 31(*a*), the arc-like parasitic element 12*f* is housed in the housing space 90*d* of the first spacer 90. Next, as shown in FIG. 31(*b*), the arc-like parasitic element 12*e* is housed in the housing space 91*d* of the second spacer 91. Then, as shown in FIG. 31(*c*), the first spacer 90 is aligned with the substrate 40 of the wideband antenna 4 according to the fourth embodiment and an upper part of the substrate 40 is inserted into the groove portion 90*f* of the first spacer 90. Further, the second spacer 91 is aligned with the substrate 40 of the wideband antenna 4 according to the fourth embodiment from an opposite side and a lower upper part of the substrate 40 is inserted into the groove portion 91*f* of the second spacer 91. Then, to make a fit between the first and second spacers 90 and 91, the engagement strips 91*c* in a pair of the second spacer 91 are inserted into the corresponding insertion holes formed in the insertion portions 90*c* in a pair of the first spacer 90. In this way, the first and second spacers 90 and 91 are fitted to each other in such a manner that the engagement strips 91*c* are retained in the insertion holes. At this time, the substrate 40 is inserted and held in the groove portion 90*f* in the first spacer 90 and the groove portion 91*f* in the second spacer 91. Further, the second substrate 45 is caught between the upright strip 90*e* of the first spacer 90 and the upright strip 91*e* of the second spacer 91 facing each other. As a result, as shown in FIGS. 30(*a*) and 30(*b*), the second substrate 45 is held to be substantially perpendicular to the substrate 40. Further, the parasitic element 12*f* housed in the first spacer 90 and the parasitic element 12*e* housed in the second spacer 91 are provided adjacent to a dipole antenna of an $n^{th}$ horizontally polarized element 46*n*. The parasitic element part 81 assembled by fitting the second spacer 91 to the first spacer 90 is disposed in a substantially intermediate position between the $n^{th}$ horizontally polarized element 46*n* and an $(n-1)^{th}$ horizontally polarized element 46($n-1$) not shown in the drawings disposed below and adjacent to the $n^{th}$ horizontally polarized element 46*n*. FIG. 31(*d*) is a top view of the wideband antenna 8 shown in FIG. 30(*a*). After the assembly, the parasitic element part 81 has a substantially cylindrical cross-sectional shape. The respective tip surfaces of the three guide strips 90*b* of the first spacer 90 and the tip surface of the guide strip 91*b* of the second spacer 91 abut on the inner circumferential surface of the cylindrical case 80. In this way, the substrate 40 and the second substrate 45 are held reliably to be perpendicular to each other in a substantially central position inside the cylindrical case 80.

The wideband antenna 4 of the fourth embodiment having a stacked structure is housed in the cylindrical case 80. Alternatively, any one of the wideband antennas according to the first to third embodiments and fifth to seventh embodiments can be housed in the cylindrical case 80. In either case, a substrate of the housed wideband antenna can be held in a substantially central position inside the cylindrical case 80 using the parasitic element part 81.

As described above, by housing a parasitic element to each of the first and second spacers 90 and 91 cut into halves the substrate 40 and the second substrate 45 are caught from lateral sides with the first and second spacers 90 and 91. This can reduce the number of assembly steps and prevent deformation or damage of a component to occur during the assembly. In particular, while the substrate 40 with vertically polarized elements in multiple stages and the second substrate 45 with horizontally polarized elements in multiple stages are coupled to each other, these substrates 40 and 45 cannot be inserted into the cylindrical case 80 easily by being moved slidingly a long distance and cannot be fixed in a constant position easily. This causes reduction in a yield during production in large quantity. In contrast, the wideband antenna 8 of the eighth embodiment of this invention can solve this problem for the reason given above.

Figure 34A:
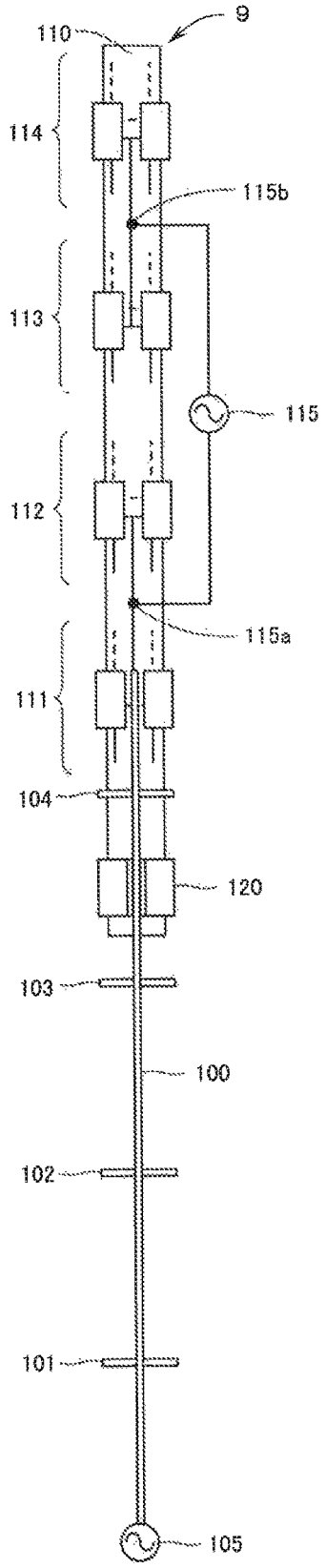
FIG. 34(*a*) is a front view showing the outline of the structure of a wideband antenna according to a ninth embodiment of this invention and FIG. 34(*b*) is a top view showing the structure of a holder.
Figure 34B:
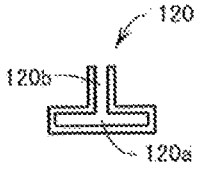
Figure 35:
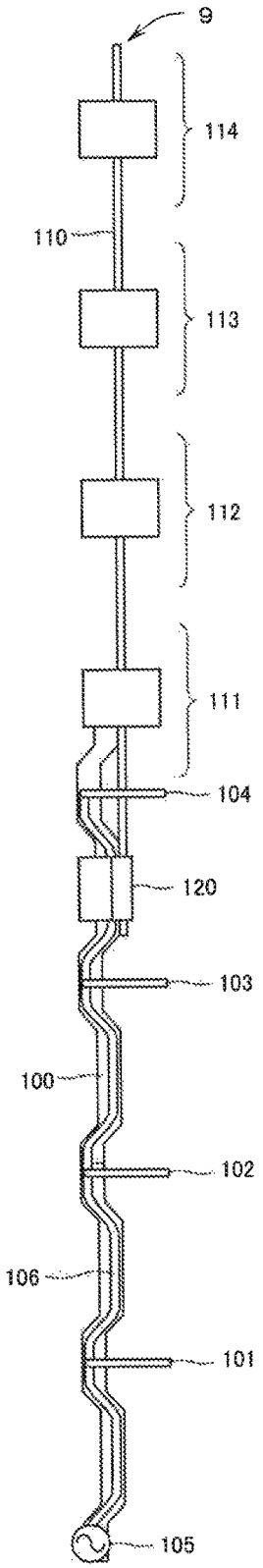
FIG. 35 is a side view showing the outline of the structure of the wideband antenna according to the ninth embodiment of this invention.

The structure of a wideband antenna 9 according to a ninth embodiment of this invention is shown in FIGS. 34 and 35. FIG. 34(*a*) is a front view showing the outline of the structure of the wideband antenna 9 according to the ninth embodiment. FIG. 34(*b*) is a top view showing the structure of a holder 120. FIG. 35 is a side view showing the outline of the structure of the wideband antenna 9 according to the ninth embodiment.

As shown in these drawings, the wideband antenna 9 of the ninth embodiment of this invention includes a vertically polarized antenna and a horizontally polarized antenna. The vertically polarized antenna is formed by stacking a first-stage vertically polarized element 111, a second-stage vertically polarized element 112, a third-stage vertically polarized element 113, and a fourth-stage vertically polarized element 114 in four stages. The first-stage to fourth-stage vertically polarized elements 111 to 114 are unit elements. The first-stage to fourth-stage vertically polarized elements 111 to 114 are each formed of hot elements in a pair formed on the front surface of a substrate 110, earth elements in a pair formed on the rear surface of the substrate 110 and forming two dipole antennas together with these hot elements, and parasitic elements provided adjacent to corresponding ones of these two dipole antennas.

The horizontally polarized antenna is formed by stacking a first-stage horizontally polarized element 101, a second-stage horizontally polarized element 102, a third-stage horizontally polarized element 103, and a fourth-stage horizontally polarized element 104 in four stages. The first-stage to fourth-stage horizontally polarized elements 101 to 104 are provided on a second substrate 100 to be located in a plane vertical to the long axis of the second substrate 100. The second substrate 100 has a long and thin rectangular shape and for example is a fluorine resin substrate having favorable high-frequency characteristics. The first-stage to fourth-stage vertically polarized elements 111 to 114 are provided on the substrate 110. The substrate 110 has a long and thin rectangular shape and for example is a fluorine resin substrate having favorable high-frequency characteristics. An upper part of the second substrate 100 from a position between the third-stage and fourth-stage horizontally polarized elements 103 and 104 to the upper end of the second substrate 100 overlaps a lower part of the substrate 110 from some point of the first-stage vertically polarized element 111 to the lower end of the substrate 110. The substrates 100 and 110 are fixedly attached with the holder 120 and a parasitic element part of the fourth-stage vertically polarized element 104 to be perpendicular to each other in these overlapping parts. The holder 120 is made of synthetic resin. As shown in FIG. 34(*b*), the holder 120 has a thin and long rectangular first holder part 120*a* of a shape substantially the same as the cross-sectional shape of the substrate 110 and a second holder part 120*b* formed as a groove substantially perpendicular to the first holder part 120*a* and having a width slightly smaller than the thickness of the second substrate 100. The first and second holder parts 120*a* and 120*b* form a T-shape groove. The substrate 110 is inserted and held in the first holder part 120*a* while the second substrate 100 is caught by the second holder part 120*b*, thereby holding the substrate 110 and the second substrate 100 to be perpendicular to each other. The parasitic element part of the fourth-stage vertically polarized element 104 includes the first and second spacers described in the eighth embodiment. As described above, the substrate 110 and the second substrate 100 are held by this parasitic element part to be perpendicular to each other.

In the vertically polarized antenna of the wideband antenna 9 according to the ninth embodiment, power from a feeding point 115 for vertical polarization is divided into two branches to be fed to a feeding point 115*a* for the first and second stages and a feeding point 115*b* for the third and fourth stages. Power from the feeding point 115*a* for the first and second stages is divided into two branches to be fed to the first-stage and second-stage vertically polarized elements 111 and 112. Power from the feeding point 115*b* for the third and fourth stages is divided into two branches to be fed to the third-stage and fourth-stage vertically polarized elements 113 and 114. In this way, the first-stage to fourth-stage vertically polarized elements 111 to 114 are fed in parallel with power distributed from the feeding point 115 for vertical polarization.

The unit element forming each stage of this vertically polarized antenna has dimensions the same as the corresponding dimensions in the wideband antenna 2 according to the second embodiment. This vertically polarized antenna operates at two frequencies in a 2.5 GHz frequency band from 2500 to 2650 MHz and a 3.5 GHz frequency band from 3200 to 3750 MHz.

The second substrate 100 is wound outward at places separated by a given gap. The first-stage to fourth-stage horizontally polarized elements 101 to 104 are provided at corresponding ones of four places of the second substrate 100 where the second substrate 100 is wound outward. A feeding line 106 is formed on the front surface of the second substrate 100. Although not shown in the drawings, the feeding line 106 is also formed on the rear surface of the second substrate 100. The first-stage to fourth-stage horizontally polarized elements 101 to 104 are provided below the first-stage vertically polarized element 111. The first-stage to fourth-stage horizontally polarized elements 101 to 104 each have a C-shape formed by bending a long and thin metal plate into an arc-like shape. The C-shaped first-stage to fourth-stage horizontally polarized elements 101 to 104 each have the same structure as the horizontally polarized element of the horizontally polarized antenna 4*b* according to the fourth embodiment. As shown in FIG. 11(*b*), the first-stage to fourth-stage horizontally polarized elements 101 to 104 are each formed as a dipole antenna including two arc-like elements each having the arc angle θ2 and the radius r2. Respective ends of the two arc-like elements on one side are each connected to the feeding lines 106 and respective ends of these arc-like elements on the opposite side are opened and face each other with intervention of a gap. A feeding point 105 for horizontal polarization is provided at the respective lower ends of the feeding lines 106 on the front and rear surfaces of the second substrate 100. The first-stage to fourth-stage horizontally polarized elements 101 to 104 are fed in series from the feeding point 105 for horizontal polarization through the feeding lines 106.

This horizontally polarized antenna is fed from the feeding point 105 for horizontal polarization. The first-stage to fourth-stage horizontally polarized elements 101 to 104 have lengths that are determined in response to an operating frequency band. For example, the arc angle θ2 is set at about 169 degrees and the radius r2 is set at about 13.5 mm for the first-stage to fourth-stage horizontally polarized elements 101 to 104. The operating frequency band is set at a 1.9 GHz frequency band from 1840 to 1960 MHz lower than an operating frequency band for the vertically polarized antenna. The length of the feeding line 106 between the first-stage to fourth-stage horizontally polarized elements 101 to 104 is adjusted so as to tilt the radiation pattern of a horizontally polarized wave downward in the wideband antenna 9. The first-stage to fourth-stage horizontally polarized elements 101 to 104 are fed in such a manner that an element in a higher stage gets a larger lead in phase.

In the wideband antenna 9 of the ninth embodiment, each distance between the first-stage to fourth-stage vertically polarized elements 1 to 114 can be set freely independently of a gap between the first-stage to fourth-stage horizontally polarized elements 101 to 104. Thus, a vertically polarized antenna conforming to intended characteristics can be formed. Respective parasitic elements of the first-stage to fourth-stage vertically polarized elements 111 to 114 can be spaced by a distance about 86% of a corresponding distance in the vertically polarized antenna of the wideband antenna 4 according to the fourth embodiment, for example. Likewise, each distance between the first-stage to fourth-stage horizontally polarized elements 101 to 104 can be set freely independently of a gap between the first-stage to fourth-stage vertically polarized elements 111 to 114. The first-stage to fourth-stage horizontally polarized elements 101 to 104 can be spaced by a distance about 157% of a corresponding distance in the horizontally polarized antenna of the wideband antenna 4 according to the fourth embodiment, for example.

As described above, in the wideband antenna 9 of the ninth embodiment, the vertically polarized antenna and the horizontally polarized antenna are independent of each other and are separated vertically from each other. This reduces an effect of one antenna on the other antenna. Thus, the vertically polarized antenna and the horizontally polarized antenna each exhibit a radiation pattern having favorable omnidirectional characteristics. This radiation pattern is tilted downward about eight degrees in a frequency band of each polarized wave. The wideband antenna 9 of the ninth embodiment of this invention can obtain a favorable VSWR in the aforementioned frequency bands.

The wideband antenna 9 according to the ninth embodiment can be housed in the cylindrical case 80 of the wideband antenna 8 according to the eighth embodiment. In this case, the substrate 110 and the second substrate 100 of the housed wideband antenna 9 can be caught by the parasitic element part formed of the first and second spacers 90 and 91 and can be held in a substantially central position inside the cylindrical case 80.

Figure 36:
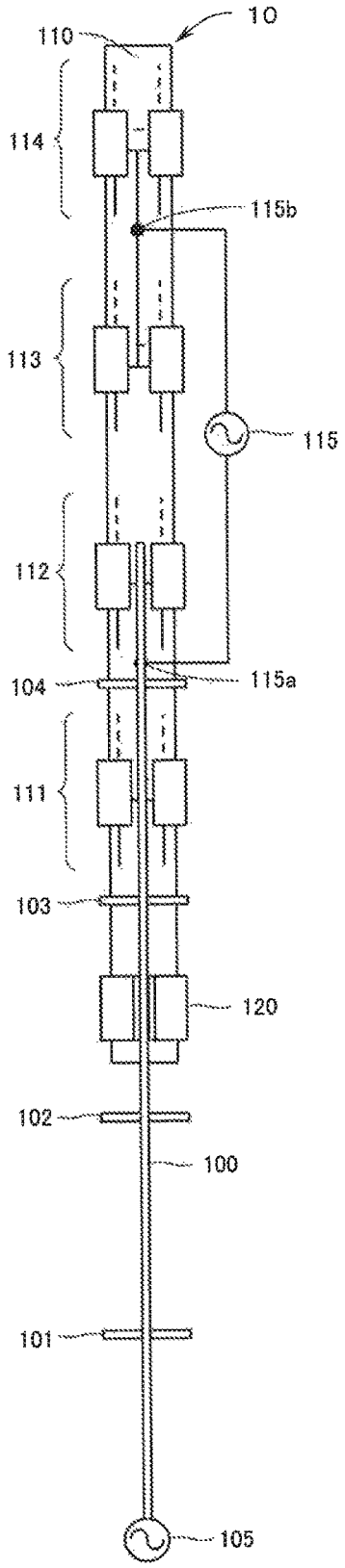
FIG. 36 is a front view showing the outline of the structure of a wideband antenna according to a tenth embodiment of this invention.
Figure 37:
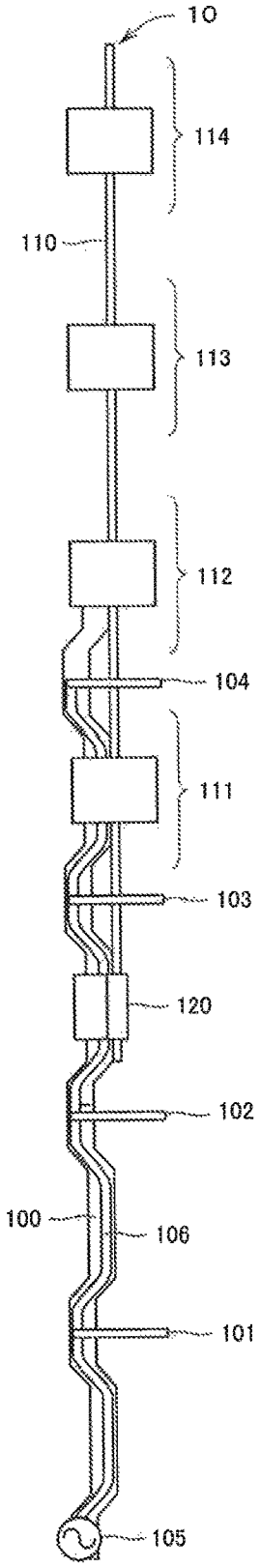
FIG. 37 is a side view showing the outline of the structure of the wideband antenna according to the tenth embodiment of this invention.

The structure of a wideband antenna 10 according to a tenth embodiment of this invention is shown in FIGS. 36 and 37. FIG. 36 is a front view showing the outline of the structure of the wideband antenna 10 according to the tenth embodiment. FIG. 37 is a side view showing the outline of the structure of the wideband antenna 10 according to the tenth embodiment.

The wideband antenna 10 of the tenth embodiment shown in these drawings has a structure where the length of the overlap between the second substrate 100 and the substrate 110 is increased, compared to the wideband antenna 9 of the ninth embodiment. More specifically, in this structure, the upper half of the second substrate 100 and the lower half of the substrate 110 overlap one another. The other structures of the wideband antenna 10 are common to the wideband antenna 9 of the ninth embodiment. Thus, except the aforementioned structure, the common structures will not be described below.

In the wideband antenna 10 of the tenth embodiment, the upper half of the second substrate 100 from a position between the third-stage and second-stage horizontally polarized elements 103 and 102 to the upper end of the second substrate 100 is disposed to overlap the lower half of the substrate 110 from some point of the second-stage vertically polarized element 112 to the lower end of the substrate 110 to be perpendicular to this lower half. An upper part of the second substrate 100 and a part of the substrate 110 where the second-stage vertically polarized element 112 is provided are fixedly attached with a parasitic element part of the second-stage vertically polarized element 112 to be perpendicular to each other. A part of the second substrate 100 between the third-stage and fourth-stage horizontally polarized elements 103 and 104 and a part of the substrate 110 where the first-stage vertically polarized element 111 is provided are fixedly attached with a parasitic element part of the first-stage vertically polarized element 111 to be perpendicular to each other. A substantially central part of the second substrate 100 between the second-stage and third-stage horizontally polarized elements 102 and 103 and a lower end portion of the substrate 110 are fixedly attached with the holder 120 to be perpendicular to each other.

In the wideband antenna 10 of the tenth embodiment, each distance between the first-stage to fourth-stage vertically polarized elements 111 to 114 can also be set freely independently of a gap between the first-stage to fourth-stage horizontally polarized elements 101 to 104. Thus, a vertically polarized antenna conforming to intended characteristics can be formed. Likewise, each distance between the first-stage to fourth-stage horizontally polarized elements 101 to 104 can be set freely independently of a gap between the first-stage to fourth-stage vertically polarized elements 111 to 114. The wideband antenna 10 of the tenth embodiment forms a radiation pattern and produces antenna characteristics substantially the same as those of the wideband antenna 9 of the ninth embodiment.

The wideband antenna 10 according to the tenth embodiment can be housed in the cylindrical case 80 of the wideband antenna 8 according to the eighth embodiment. In this case, the substrate 110 and the second substrate 100 of the housed wideband antenna 10 can be caught by the parasitic element part formed of the first and second spacers 90 and 91 and can be held in a substantially central position inside the cylindrical case 80. Regarding a degree of the overlap between the second substrate 100 and the substrate 110, the length of this overlap can be determined arbitrarily.

Figure 38:
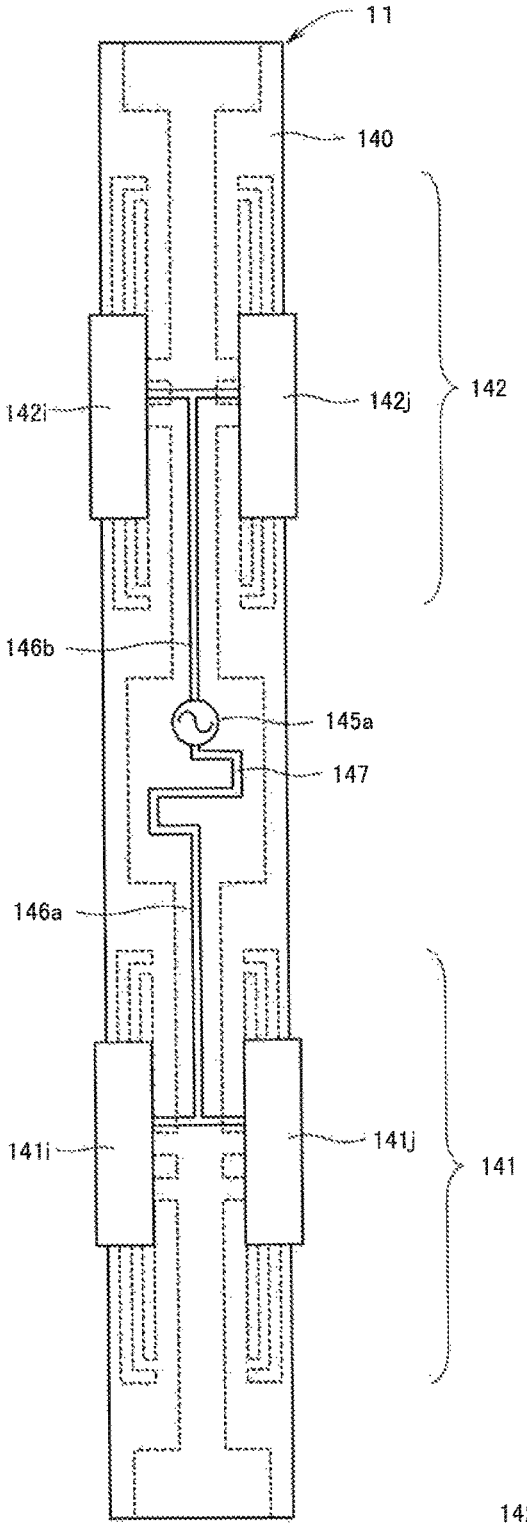
FIGS. 38(*a*) and 38(*b*) are a front view and a top view respectively showing the structure of a wideband antenna according to an eleventh embodiment of this invention.
Figure 38:
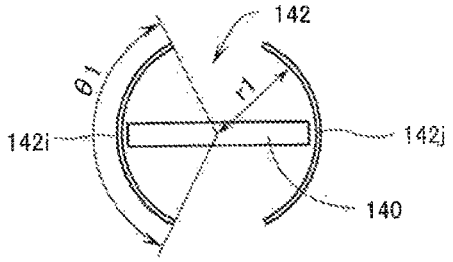
Figure 39:
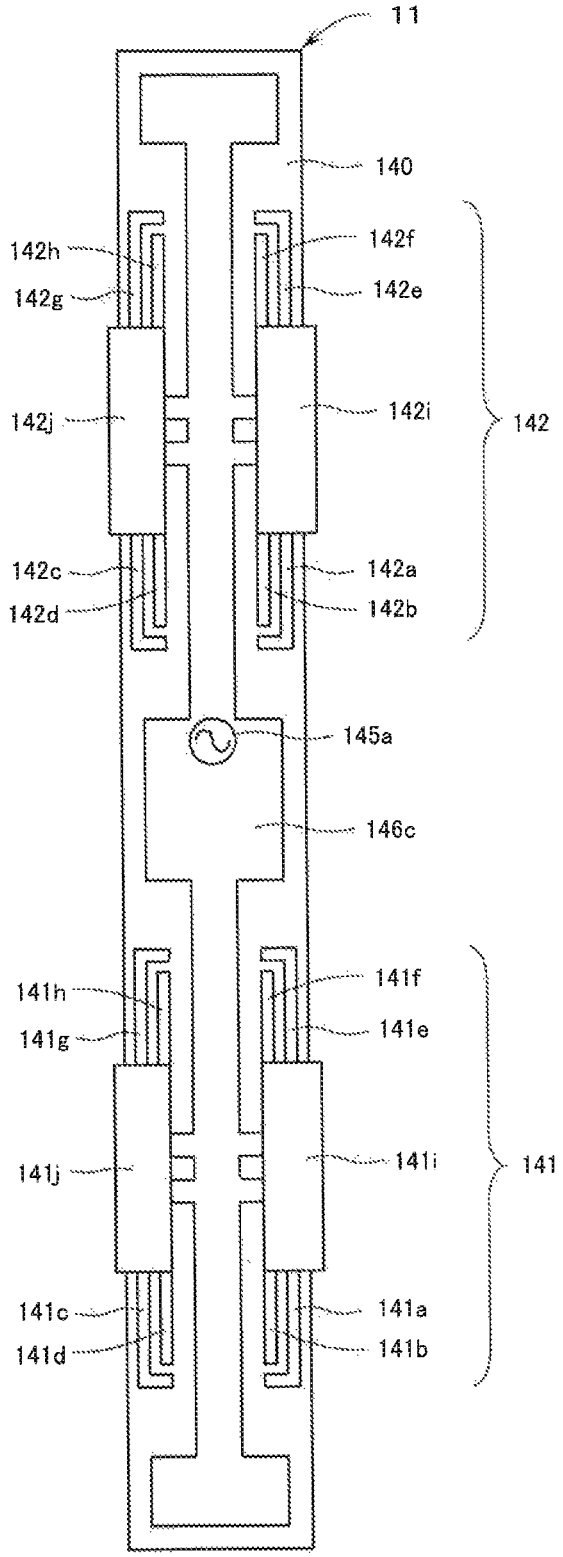
FIG. 39 is a back view showing the structure of the wideband antenna according to the eleventh embodiment of this invention.
Figure 40A:
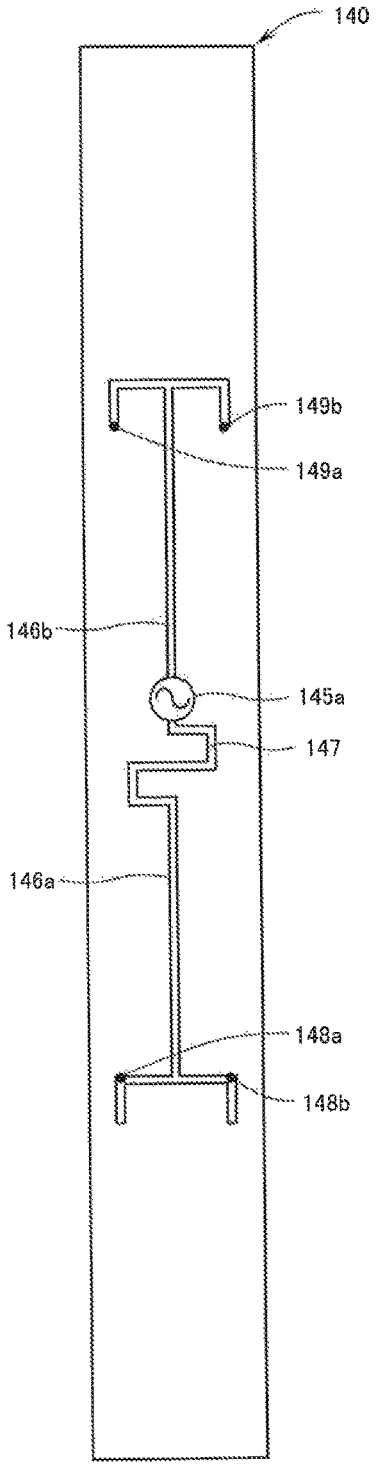
FIGS. 40(*a*) and 40(*b*) are a front view and a back view respectively showing the structure of a substrate of the wideband antenna according to the eleventh embodiment of this invention.
Figure 40B:
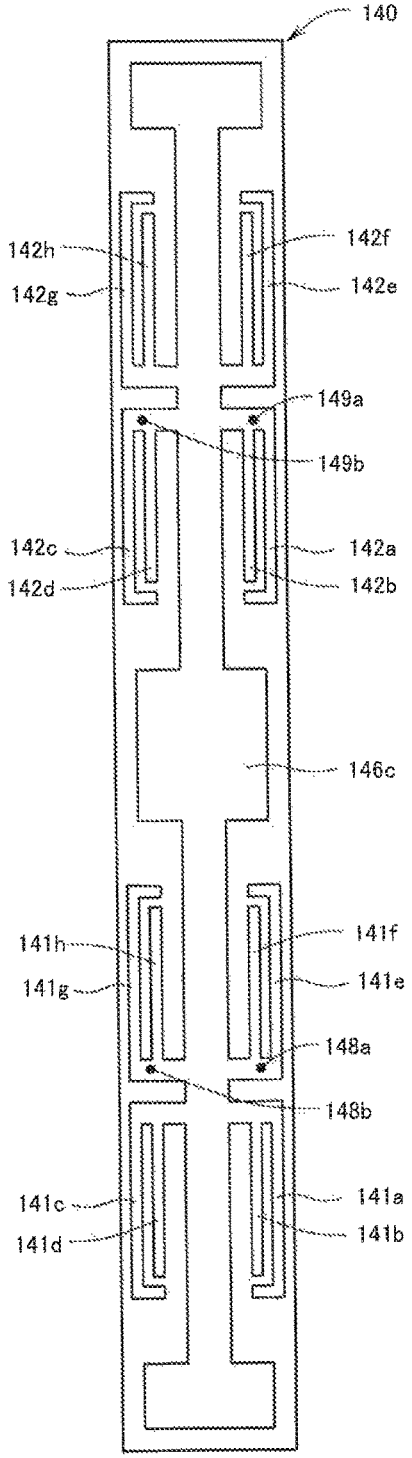
Figure 41:
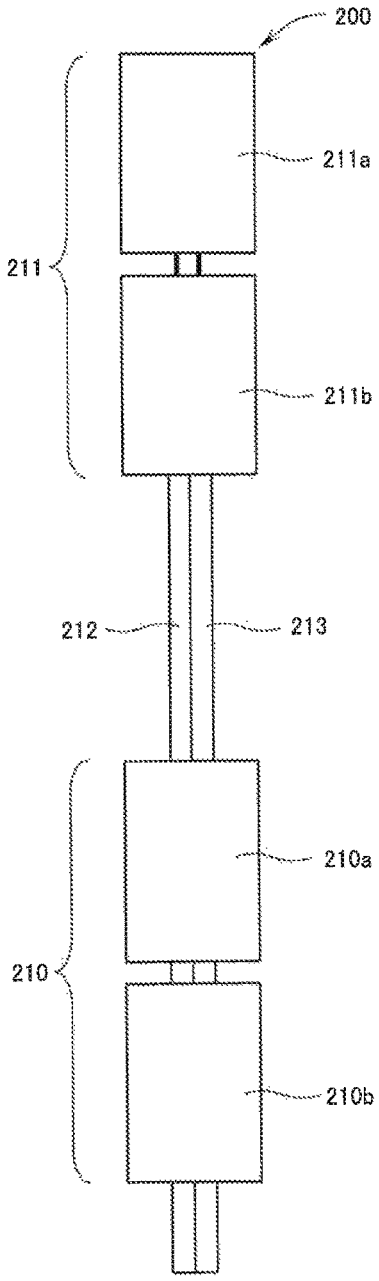
FIGS. 41(*a*) and 41(*b*) show the structure of a collinear antenna as a conventional wideband antenna.
Figure 41:
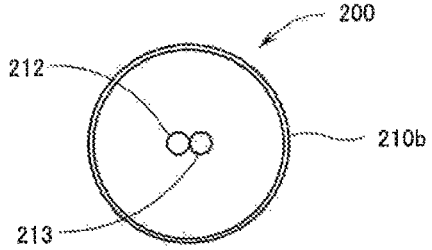

The structure of a wideband antenna 11 according to an eleventh embodiment of this invention is shown in FIGS. 38 to 40. FIGS. 38(*a*) and 38(*b*) are a front view and a top view respectively showing the structure of the wideband antenna 11 according to the eleventh embodiment. FIG. 39 is a back view showing the structure of the wideband antenna 11 according to the eleventh embodiment. FIGS. 40(*a*) and 40(*b*) are a front view and a back view respectively showing the structure of a substrate of the wideband antenna 11 according to the eleventh embodiment.

The wideband antenna 11 of the eleventh embodiment of this invention is shown in these drawings corresponds to the wideband antenna 5 of the aforementioned fifth embodiment of this invention and differs from the wideband antenna 5 in that the wideband antenna 11 operates at three frequencies. The wideband antenna 11 of the eleventh embodiment of this invention includes a substrate 140 provided with a first-stage element 141 and a second-stage element 142. The first-stage and second-stage elements 141 and 142 are formed of unit elements of the same structure. The substrate 140 has a long and thin rectangular shape and for example is a fluorine resin substrate having favorable high-frequency characteristics. Two first hot elements including a hot element 141*a* and a hot element 141*c*, two second hot elements including a hot element 141*b* and a hot element 141*d*, two first earth elements including an earth element 141*e* and an earth element 141*g*, and two second earth elements including an earth element 141*f* and an earth element 141*h* in the first-stage element 141 extend along the opposite edges of the rear surface of the substrate 140 in the longitudinal direction. Further, two first hot elements including a hot element 142*a* and a hot element 142*c*, two second hot elements including a hot element 142*b* and a hot element 142*d*, two first earth elements including an earth element 142*e* and an earth element 142*g*, and two second earth elements including an earth element 142*f* and an earth element 142*h* in the second-stage element 142 extend along the opposite edges of the rear surface of the substrate 140 in the longitudinal direction. The first hot elements 141*a* and 141*c* (142*a* and 142*c*) and the first earth elements 141*e* and 141*g* (142*e* and 142*g*) form two dipole antennas in a pair. These dipole antennas in a pair have an element length longer than the element length of dipole antennas in a pair formed of the second hot elements 141*b* and 141*d* (142*b* and 142*d*) and the second earth elements 141*f* and 141*h* (142*f* and 142*h*). The former dipole antennas in a pair operate in a frequency band shorter than an operating frequency band for the latter dipole antennas in a pair. The dipole antennas in two pairs of different element lengths in each of the first-stage and second-stage elements 141 and 142 allows operation at two frequencies.

An arc-like parasitic element 141*i* and an arc-like parasitic element 141*j* are provided adjacent to the aforementioned dipole antennas in two pairs of the first-stage element 141 in such a manner as to surround the opposite edges of the substrate 140 where these dipole antennas are formed. Likewise, an arc-like parasitic element 142*i* and an arc-like parasitic element 142*j* are provided adjacent to the aforementioned dipole antennas in two pairs of the second-stage element 142 in such a manner as to surround the opposite edges of the substrate 140 where these dipole antennas are formed. Like the aforementioned wideband antenna 1 according to the first embodiment, the parasitic elements 141*i*, 141*j*, 142*i*, and 142*j* have the radius r1 and the arc angle θ1. By the action of the parasitic elements 141*i*, 141*j*,

142*i*, and 142*j*, the first-stage and second-stage elements 141 and 142 become a vertically polarized antenna to operate at three frequencies.

A feeding point 145*a* for the first and second stages is arranged in a position slightly above a substantially central part of the substrate 140. A first branch line 146*a* including an interposed phase line 147 and a second branch line 146*b* are connected to a hot side of the feeding point 145*a* and formed on the front surface of the substrate 140 in such a manner as to extend upward and downward substantially along the center line of the front surface in the longitudinal direction. The phase line 147 is wound in a meander shape. Alternatively, the phase line 147 may be formed of a distributed constant line or a concentrated constant line. The first branch line 146*a* extending downward from the feeding point 145*a* through the phase line 147 has a tip formed into a T-shape. A portion of the first branch line 146*a* extending further from the T-shape portion is bent downward. A through hole 148*a* and a through hole 148*b* are formed at the respective corners of the bent portions. The first hot elements 141*a* and 141*c* and the second hot elements 141*b* and 141*d* of the first-stage element 141 are fed through the through holes 148*a* and 148*b*. The second branch line 146*b* extending upward from the feeding point 145*a* has a tip formed into a T-shape. A portion of the second branch line 146*b* extending further from the T-shape portion is bent downward. A through hole 149*a* and a through hole 149*b* are formed at the respective tips of the bent portions. The first hot elements 142*a* and 142*c* and the second hot elements 142*b* and 142*d* of the second-stage element 142 are fed through the through holes 149*a* and 149*b*. A wide earth line 146*c* connected to an earth side of the feeding point 145*a* is formed on the rear surface of the substrate 140 in such a manner as to extend upward and downward substantially along the center line of the rear surface in the longitudinal direction. The earth line 146*c* extending downward from the feeding point 145*a* is connected to respective end portions of the first earth elements 141*e* and 141*g* of the first-stage element 141 bent into an L-shape in such a manner that the respective lower portions of the first earth elements 141*e* and 141*g* face each other. The earth line 146*c* extending downward from the feeding point 145*a* is further connected to respective end portions of the second earth elements 141*f* and 141*h* of the first-stage element 141 bent into an L-shape in such a manner that the respective lower portions of the second earth elements 141*f* and 141*h* face each other. The earth line 146*c* extending upward from the feeding point 145*a* is connected to the first earth elements 142*e* and 142*g* of the second-stage element 142 bent into an L-shape in such a manner that the respective lower portions of the first earth elements 142*e* and 142*g* face each other. The earth line 146*c* extending upward from the feeding point 145*a* is further connected to the second earth elements 142*f* and 142*h* of the second-stage element 142 bent into an L-shape in such a manner that the respective lower portions of the second earth elements 142*f* and 142*h* face each other. In this way, the first-stage and second-stage elements 141 and 142 are fed from the feeding point 145*a* through a transmission line including the first branch line 146*a* with the interposed phase line 147, the second branch line 146*b*, and the earth line 146*c*.

The phase line 147 and the first and second branch lines 146*a* and 146*b* formed on the front surface of the substrate 140 extend over the wide earth line 146*c* formed on the rear surface of the substrate 140 and the aforementioned transmission line functions as a stripline. The first-stage and second-stage elements 141 and 142 are fed in parallel from the feeding point 145*a* through the stripline. The feed of the first-stage element 141 is delayed only by the phase amount of the phase line 147, compared to the second-stage element 142. As a result, if the wideband antenna 11 of the eleventh embodiment is placed in a standing posture in a vertical plane, a radiation pattern is tilted downward in response to the phase amount of the phase line 147.

The wideband antenna 11 of the eleventh embodiment of this invention functions as a three-frequency vertically polarized antenna to operate in a 1.9 GHz frequency band from 1840 to 1960 MHz, a 2.5 GHz frequency band from 2500 to 2650 MHz, and a 3.5 GHz frequency band from 3200 to 3750 MHz. Dimensions relating to this vertically polarized antenna except the dimensions of the first hot elements 141*a* and 141*c* (142*a* and 142*c*) and those of the first earth elements 141*e* and 141*g* (142*e* and 142*g*) are the same as the corresponding dimensions relating to the wideband antenna 2 of the second embodiment. The wideband antenna 11 of the eleventh embodiment can obtain a favorable VSWR in the aforementioned frequency bands. The dimensions of the first hot elements 141*a* and 141*c* (142*a* and 142*c*) and those of the first earth elements 141*e* and 141*g* (142*e* and 142*g*) are determined to be a length that allows operation in a 1.9 GHz frequency band from 1840 to 1960 MHz The unit elements of the wideband antenna 11 according to the eleventh embodiment to operate at three frequencies may be applied as unit elements of a wideband antenna according to a different embodiment of this invention to make the wideband antenna of this different embodiment operate at three frequencies. Additionally, the wideband antenna 11 of the eleventh embodiment may be stacked in multiple stages and housed in the cylindrical case 80. In this case, the substrates 140 of the housed wideband antennas 11 can be caught by the first and second spacers 90 and 91 and can be held in a substantially central position inside the cylindrical case 80.

INDUSTRIAL APPLICABILITY

In the aforementioned wideband antenna of this invention, an arc-like parasitic element is provided adjacent to a dipole antenna to form a unit element and such unit elements can be stacked in multiple stages. The number of the stages is preferably from eight to 18. The wideband antenna of this invention functions as a wideband antenna to operate in a plurality of frequency bands. In the wideband antenna of this invention including a vertically polarized antenna and a horizontally polarized antenna, unit elements corresponding to the vertically polarized antennas can be stacked in multiple stages and horizontally polarized elements forming the horizontally polarized antenna can be stacked in multiple stages. The number of the stages of the horizontally polarized elements to be stacked is preferably from 15 to 25.

In the wideband antenna of this invention including a vertically polarized antenna and a horizontally polarized antenna, electromagnetic coupling may occur between a unit element corresponding to the vertically polarized antenna and a C-shape horizontally polarized element forming the horizontally polarized antenna. In this case, antenna characteristics might be affected. By setting the arc angle of an arc-like parasitic element at about 90 degrees or more and less than 180 degrees, effects on the horizontally polarized antenna can be alleviated while the antenna characteristics of the vertically polarized antenna are maintained.

Each of a hot element and an earth element forming a unit element of the wideband antenna according to this invention has an electrical length responsive to a usable frequency band. This electrical length is generally set at a quarter of the wavelength of the center frequency of the usable frequency band, for example. In this case, a physical length is determined in consideration of a wavelength shortening rate determined by using the dielectric constant of a substrate. A parasitic element has a length that broadens a frequency band if the parasitic element is provided adjacent to a dipole antenna formed of a hot element and an earth element.

In the wideband antenna of the eleventh embodiment, hot elements in two pairs differing in length between the pairs and earth elements in two pairs differing in length between the pairs are provided in each stage in such a manner that the hot elements and the earth elements extend along the opposite edges of a substrate in the longitudinal direction and that the hot elements and the earth elements face each other. In this way, a unit element is caused to operate at three frequencies. This unit element may be applied as a unit element of a different embodiment to make the unit element of this different embodiment operate at three frequencies.

In the wideband antenna of this invention according to each of the aforementioned embodiments, a tilt angle is eight degrees. Alternatively, the tilt angle may be any angle (such as three or five degrees, for example).

REFERENCE SINGS LIST

1 to 11 Wideband antenna
4*a* Vertically polarized antenna
4*b* Horizontally polarized antenna
10 Substrate
11 First-stage element
11*a*, 11*b* Hot element
11*c*, 11*d* Earth element
11*e*, 11*f* Parasitic element
12 Second-stage element
12*a*, 12*b* Hot element
12*c*, 12*d* Earth element
12*e*, 12*f* Parasitic element
13 Feeding point
14*a* First branch line
14*b* Second branch line
14*c* Earth line
20 Substrate
21 First-stage element
21*a*, 21*b* Hot element
21*c*, 21*d* Earth element
21*e*, 21*f*, 22*e*, 22*f* Parasitic element
22 Second-stage element
22*a*, 22*b* Hot element
22*c*, 22*d* Earth element
23 Feeding point
24*a* First branch line
24*b* Second branch line
24*c* Earth line
25*a*, 26*a* Through hole
31 First-stage element
32 Second-stage element
33 Third-stage element
34 Fourth-stage element
35 Fifth-stage element
36 Sixth-stage element
37 Seventh-stage element
38 Eighth-stage element
39 Feeding point for first to eighth stages
39*a* Feeding point for first to fourth stages
39*b* Feeding point for fifth to eighth stages
39*c* Feeding point for first and second stages
39*d* Feeding point for third and fourth stages
39*e* Feeding point for fifth and sixth stages
39*f* Feeding point for seventh and eighth stages
40 Substrate
41 First vertically polarized element
42 Second vertically polarized element
45 Second substrate
46*a* First horizontally polarized element
46*b* Second horizontally polarized element
46*c* Gap
47*a* Feeding line for horizontal polarization
47*b* Feeding line for horizontal polarization
48 Feeding point for horizontal polarization
50 Substrate
51 First-stage element
52 Second-stage element
53 Feeding point
54*a* First branch line
54*b* Second branch line
54*c* Earth line
55*a*, 56*a* Through hole
57 Phase line
80 Cylindrical case
81 Parasitic element part
90 First spacer
90*b* Guide strip
90*c* Insertion portion
90*d* Housing space
90*e* Upright strip
90*f* Groove portion
91 Second spacer
91*b* Guide strip
91*c* Engagement strip
91*d* Housing space
91*e* Upright strip
91*f* Groove portion
100 Second substrate
101 First-stage horizontally polarized element
102 Second-stage horizontally polarized element
103 Third-stage horizontally polarized element
104 Fourth-stage horizontally polarized element
105 Feeding point for horizontal polarization
106 Feeding line
110 Substrate
111 First-stage vertically polarized element
112 Second-stage vertically polarized element
113 Third-stage vertically polarized element
114 Fourth-stage vertically polarized element
120 Holder
140 Substrate
141*a*, 141*c* First hot element
141*b*, 141*d* Second hot element
141*e*, 141*g* First earth element
141*f*, 141*h* Second earth element
141*i*, 141*j* Parasitic element
142*a*, 142*c* First hot element
142*b*, 142*d* Second hot element
142*e*, 142*g* First earth element
142*f*, 142*h* Second earth element
142*i*, 142*j* Parasitic element
145*a* Feeding point for first and second stages
146*a* First branch line
146*b* Second branch line
146*c* Earth line
147 Phase line
148*a*, 148*b* Through hole

149*a*, 149*b* Through hole
200 Collinear antenna
210 First-stage sleeve element
210*a* Upper sleeve pipe
210*b* Lower sleeve pipe
211 Second-stage sleeve element
211*a* Upper sleeve pipe
211*b* Lower sleeve pipe
212 Feeding cable
213 Feeding cable

The invention claimed is:

1. A wideband antenna comprising:

a long and thin substrate including dipole antennas formed in multiple stages and arranged in a longitudinal direction, the dipole antennas each being formed of a hot element formed on one surface and an earth element formed on an opposite surface;

an arc-like parasitic element provided adjacent to the dipole antenna;

a branch line formed on the one surface of the substrate, connected to a hot side of a feeding point, and used for feeding the hot elements in the multiple stages; and an earth connection line formed on the opposite surface of the substrate, connected to an earth side of the feeding point, and used for feeding the earth elements in the multiple stages;

further comprising: a second substrate disposed substantially perpendicular to the substrate; and a C-shape dipole antenna installed on the second substrate and surrounding the substrate wherein a polarized wave emitted from the C-shape dipole antenna is perpendicular to a polarized wave emitted from unit elements formed of the dipole antennas and the parasitic elements in the multiple stages.

2. The wideband antenna according to claim 1, wherein the hot element includes hot elements in a pair extending along opposite edges of the one surface of the substrate in the longitudinal direction, the earth element includes earth elements in a pair extending along opposite edges of the opposite surface of the substrate in the longitudinal direction in such a manner as to face the two hot elements, and the arc-like parasitic element is provided adjacent to a corresponding one of two of the dipole antennas formed of the hot elements in a pair and the earth elements in a pair facing each other.

3. The wideband antenna according to claim 1, wherein the dipole antenna and the parasitic element form a unit element, a transmission line is provided in such a manner that the unit elements in the multiple stages are fed in parallel from the feeding point, and a phase line is interposed in the transmission line to tilt a radiation pattern in response to the phase amount of the phase line.

4. The wideband antenna according to claim 1, wherein the hot element includes hot elements in two pairs extending along opposite edges of the substrate in the longitudinal direction and differing in length between the pairs, the earth element includes earth elements in two pairs extending along the opposite edges of the substrate in the longitudinal direction, differing in length between the pairs, and facing the hot elements in two pairs differing in length between the pairs, and the arc-like parasitic element is provided adjacent to corresponding two of dipole antennas in two pairs formed of the hot elements in two pairs and the earth elements in two pairs facing each other.

5. The wideband antenna according to claim 1, wherein the arc-like parasitic element has an arc angle of 90 degrees or more and less than 180 degrees.

6. The wideband antenna according to claim 1, wherein the arc-like parasitic element has an arc angle of 90 degrees or more and less than 180 degrees.

7. The wideband antenna according to claim 6, comprising a spacer formed of a first spacer and a second spacer each having a shape corresponding to a half of a cylinder, wherein the second spacer is fitted to the first spacer in such a manner that the first and second spacers together form a substantially cylindrical shape so as to hold the second substrate relative to the substrate.

8. The wideband antenna according to claim 6, comprising a spacer formed of a first spacer and a second spacer each having a shape corresponding to a half of a cylinder, wherein the second spacer is fitted to the first spacer in such a manner that the first and second spacers together form a substantially cylindrical shape so as to hold the second substrate relative to the substrate, thereby housing the arc-like parasitic element in each of the first and second spacers.

9. The wideband antenna according to claim 6, comprising:

a first spacer having a shape corresponding to a half of a cylinder and having a guide strip projecting from an outer circumferential surface;

a second spacer having a shape corresponding to a half of a cylinder and having a guide strip projecting from an outer circumferential surface; and a cylindrical case that houses the first and second spacers fitted to each other in such a manner as to hold the second substrate relative to the substrate, wherein the respective tips of the guide strips of the first and second spacers abut on an inner circumferential surface of the cylindrical case to hold the substrate and the second substrate in a substantially central position inside the cylindrical case.

10. The wideband antenna according to claim 1, comprising a spacer formed of a first spacer and a second spacer each having a shape corresponding to a half of a cylinder, wherein the second spacer is fitted to the first spacer in such a manner that the first and second spacers together form a substantially cylindrical shape so as to hold the second substrate relative to the substrate.

11. The wideband antenna according to claim 1, comprising a spacer formed of a first spacer and a second spacer each having a shape corresponding to a half of a cylinder, wherein the second spacer is fitted to the first spacer in such a manner that the first and second spacers together form a substantially cylindrical shape so as to hold the second substrate relative to the substrate, thereby housing the arc-like parasitic element in each of the first and second spacers.

12. The wideband antenna according to claim 1, comprising: a first spacer having a shape corresponding to a half of a cylinder and having a guide strip projecting from an outer circumferential surface; a second spacer having a shape corresponding to a half of a cylinder and having a guide strip projecting from an outer circumferential surface; and a cylindrical case that houses the first and second spacers fitted to each other in such a manner as to hold the second substrate relative to the substrate, wherein the respective tips of the guide strips of the first and second spacers abut on an inner circumferential surface of the cylindrical case to hold the substrate and the second substrate in a substantially central position inside the cylindrical case.

13. A wideband antenna comprising:

a long and thin substrate including dipole antennas formed in multiple stages and arranged in a longitudinal direction, the dipole antennas each being formed of a hot element and an earth element formed on one surface;

an arc-like parasitic element provided adjacent to the dipole antenna; a branch line formed on an opposite surface of the substrate, connected to a hot side of a feeding point, and used for feeding the hot elements in the multiple stages; and an earth connection line formed on the one surface of the substrate, connected to an earth side of the feeding point, and used for feeding the earth elements in the multiple stages, further comprising: a second substrate disposed substantially perpendicular to the substrate; and a C-shape dipole antenna installed on the second substrate and surrounding the substrate, wherein a polarized wave emitted from the C-shape dipole antenna is perpendicular to a polarized wave emitted from unit elements formed of the dipole-antennas and the parasitic elements in the multiple stages.

14. The wideband antenna according to claim 13, wherein the hot element includes hot elements in a pair extending along opposite edges of the one surface of the substrate in the longitudinal direction, the earth element includes earth elements in a pair extending along the opposite edges of the one surface of the substrate in the longitudinal direction in such a manner as to face the two hot elements, and the arc-like parasitic element is provided adjacent to a corresponding one of two of the dipole antennas formed of the hot elements in a pair and the earth elements in a pair facing each other.

15. The wideband antenna according to claim 13, wherein the dipole antenna and the parasitic element form a unit element, a transmission line is provided in such a manner that the unit elements in the multiple stages are fed in parallel from the feeding point, and a phase line is interposed in the transmission line to tilt a radiation pattern in response to the phase amount of the phase line.

16. The wideband antenna according to claim 13, wherein the hot element includes hot elements in two pairs extending along opposite edges of the substrate in the longitudinal direction and differing in length between the pairs, the earth element includes earth elements in two pairs extending along the opposite edges of the substrate in the longitudinal direction, differing in length between the pairs, and facing the hot elements in two pairs differing in length between the pairs, and the arc-like parasitic element is provided adjacent to corresponding two of dipole antennas in two pairs formed of the hot elements in two pairs and the earth elements in two pairs facing each other.

17. The wideband antenna according to claim 13, wherein the arc-like parasitic element has an arc angle of 90 degrees or more and less than 180 degrees.

18. The wideband antenna according to claim 13, wherein the arc-like parasitic element has an arc angle of 90 degrees or more and less than 180 degrees.

19. The wideband antenna according to claim 18, comprising a spacer formed of a first spacer and a second spacer each having a shape corresponding to a half of a cylinder, wherein the second spacer is fitted to the first spacer in such a manner that the first and second spacers together form a substantially cylindrical shape so as to hold the second substrate relative to the substrate.

20. The wideband antenna according to claim 18, comprising a spacer formed of a first spacer and a second spacer each having a shape corresponding to a half of a cylinder, wherein the second spacer is fitted to the first spacer in such a manner that the first and second spacers together form a substantially cylindrical shape so as to hold the second substrate relative to the substrate, thereby housing the arc-like parasitic element in each of the first and second spacers.

21. The wideband antenna according to claim 18, comprising:

a first spacer having a shape corresponding to a half of a cylinder and having a guide strip projecting from an outer circumferential surface;

a second spacer having a shape corresponding to a half of a cylinder and having a guide strip projecting from an outer circumferential surface; and a cylindrical case that houses the first and second spacers fitted to each other in such a manner as to hold the second substrate relative to the substrate, wherein the respective tips of the guide strips of the first and second spacers abut on an inner circumferential surface of the cylindrical case to hold the substrate and the second substrate in a substantially central position inside the cylindrical case.

22. The wideband antenna according to claim 13, comprising a spacer formed of a first spacer and a second spacer each having a shape corresponding to a half of a cylinder, wherein the second spacer is fitted to the first spacer in such a manner that the first and second spacers together form a substantially cylindrical shape so as to hold the second substrate relative to the substrate.

23. The wideband antenna according to claim 13, comprising a spacer formed of a first spacer and a second spacer each having a shape corresponding to a half of a cylinder, wherein the second spacer is fitted to the first spacer in such a manner that the first and second spacers together form a substantially cylindrical shape so as to hold the second substrate relative to the substrate, thereby housing the arc-like parasitic element in each of the first and second spacers.

24. The wideband antenna according to claim 13, comprising; a first spacer having a shape corresponding to a half of a cylinder and having a guide strip projecting from an outer circumferential surface; a second spacer having a shape corresponding to a half of a cylinder and having a guide strip projecting from an outer circumferential surface; and a cylindrical ease that houses the first and second spacers fitted to each other in such a manner as to hold the second substrate relative to the substrate, wherein the respective tips of the guide strips of the first and second spacers abut on an inner circumferential surface of the cylindrical case to hold the substrate and the second substrate in a substantially central position inside the cylindrical case.

* * * * *